US009814638B2

(12) United States Patent
Yang

(10) Patent No.: US 9,814,638 B2
(45) Date of Patent: Nov. 14, 2017

(54) MEDICAL REHABILITATION BED

(71) Applicant: Weizhong Yang, Suzhou (CN)

(72) Inventor: Weizhong Yang, Suzhou (CN)

( * ) Notice: Subject to any disclaimer, the term of this patent is extended or adjusted under 35 U.S.C. 154(b) by 0 days.

(21) Appl. No.: 15/325,091

(22) PCT Filed: Jun. 3, 2015

(86) PCT No.: PCT/CN2015/080651

§ 371 (c)(1),
(2) Date: Jan. 10, 2017

(87) PCT Pub. No.: WO2016/004803

PCT Pub. Date: Jan. 14, 2016

(65) Prior Publication Data

US 2017/0156955 A1 Jun. 8, 2017

(30) Foreign Application Priority Data

Jul. 11, 2014 (CN) ..... 2014 1 0332253

(51) Int. Cl.
*A61G 7/002* (2006.01)
*A61G 7/015* (2006.01)
*A61G 7/018* (2006.01)

(52) U.S. Cl.
CPC ..... *A61G 7/002* (2013.01); *A61G 7/015* (2013.01); *A61G 7/018* (2013.01)

(58) Field of Classification Search
CPC ..... A61G 7/06; A61G 7/002; A61G 7/015; A61G 7/018; A61G 7/012; B66B 11/0446; B66B 9/022; B66B 9/0025; F16H 57/038
See application file for complete search history.

(56) References Cited

U.S. PATENT DOCUMENTS 3,281,872 A * 11/1966 Dewey ..... A61G 7/012 5/611
3,628,199 A * 12/1971 Helton ..... A61G 7/012 5/611

(Continued)

FOREIGN PATENT DOCUMENTS

CN 2428113 Y 5/2001
CN 104068979 A 10/2014

(Continued)

*Primary Examiner* — Nicholas F Polito
*Assistant Examiner* — Amanda L Bailey
(74) *Attorney, Agent, or Firm* — Gokalp Bayramoglu

(57) ABSTRACT

A medical rehabilitation bed is disclosed, relating to the technical field of self-help rehabilitation bed structures in medical instrument products. The medical rehabilitation bed comprises a bed head, a bed tail and a bed board. A pull rod is arranged at the bottom of the bed board; one end of the pull rod is mechanically connected to a bed head gearbox arranged at the bed head, and the other end of the pull rod is mechanically connected to a bed tail gear device arranged at the bed tail. Transmission systems having the same structure and capable of controlling the bed head and the bed tail to ascend and descend are arranged in the bed head and the bed tail, respectively. The transmission systems are mechanically connected to the bed head gearbox and the bed tail gear device, respectively. The medical rehabilitation bed has a compact structure and comprehensive functions.

5 Claims, 12 Drawing Sheets

(56) References Cited

U.S. PATENT DOCUMENTS

| | | | | | |
|---|---|---|---|---|---|
| 5,134,731 | A * | 8/1992 | Quintile | A47C 19/045 | 192/141 |
| 5,802,639 | A * | 9/1998 | Raasch | A61G 7/012 | 5/611 |
| 6,983,495 | B2 * | 1/2006 | Snyder | A61G 7/012 | 5/11 |
| 7,439,433 | B1 | 10/2008 | Hsieh | | |
| 7,441,289 | B2 * | 10/2008 | Loewenthal | A47C 19/045 | 5/11 |
| 8,418,283 | B2 * | 4/2013 | Serhan | A47C 19/045 | 5/11 |
| 8,424,135 | B2 * | 4/2013 | Serhan | A47C 19/045 | 5/11 |
| 2004/0148698 | A1 * | 8/2004 | Snyder | A47C 19/045 | 5/11 |

FOREIGN PATENT DOCUMENTS

| | | | | |
|---|---|---|---|---|
| CN | 203970731 | U | 12/2014 | |
| DE | 3640162 | A1 | 5/1988 | |
| DE | 102009005343 | A1 * | 7/2010 | F16H 57/021 |
| DE | 102009005344 | A1 * | 8/2010 | F16H 1/125 |

* cited by examiner

MEDICAL REHABILITATION BED

CROSS REFERENCE TO RELATED APPLICATIONS

This application is the national phase entry of International Application No. PCT/CN2015/080651, filed on Jun. 3, 2015, which is based upon and claims priority to Chinese Patent Application No. 201410332253.9, filed on Jul. 11, 2014, the entire contents of which are incorporated herein by reference.

BACKGROUND OF THE INVENTION

Technical Field

The present invention relates to a medical rehabilitation bed, belonging to the technical field of product structures of medical appliances, specifically belonging to the technical field of self-help rehabilitation bed structures in medical instrument products.

Description of Related Art

At present, various medical rehabilitation beds are commercially available on the market, the majority of which are structured to have fixed bed boards and bed stands. The height adjustment of beds is carried out with the bed stands by caretakers and family members. Traditional transmission mechanisms are heavy, labor-some and noisy, which directly or indirectly affects the treatment quality of patients. According to the physical conditions of patients and to the treatment requirements, patients need to sit upright or a certain part is needed to rise, for example, adjustment to the head or the feet. Therefore, a medical rehabilitation bed which is simple in adjustment, convenient and safe, and can be operated by patients themselves by their own requirements is needed.

SUMMARY OF THE INVENTION

Aiming at defects of the prior art, the present invention provides a medical rehabilitation bed to achieve the objectives of simple and excellent structure, safety in use, light weight, diversified and flexible functions.

To achieve the above objectives, the present invention employs the following technical solution:

A medical rehabilitation bed includes a bed head, a bed tail and a bed board, wherein a pull rod is arranged at the bottom of the bed board; the pull rod is rod-like with one end mechanically connected to a bed head gearbox which is arranged at the bed head, and the other end mechanically connected to a bed tail gear device which is arranged at the bed tail; transmission systems having the same structure and capable of controlling the bed head and the bed tail to ascend and descend are respectively arranged in the bed head and the bed tail; and the transmission systems are mechanically connected to the bed head gearbox and the bed tail gear device, respectively.

The bed head includes a bed stand, a bed head board, a bed head frame, roller bayonets, bayonets, connectors, connector dowel pins, lifting racks, roller fixing blocks and rollers.

The bed stand is a dual-leg upper-lower framework structure. The bed head frame is processed as a groove-shaped rigid lath structure, and is fixed at the upper border of the bed stand through plural bed head frame fixing screws. The upper border of the bed stand is a bottom-open groove-shaped structure. The lower border of the bed stand is a top-open groove-shaped structure. The two ends of the lower border are respectively in fastening connection with the two legs of the bed stand. The bed head board is a rigid plate structure, fixed at the upper and lower borders of the bed stand on two sides through plural bed head frame fixing screws.

Bed legs are hollow cylindrical rigid structures. A long hole is formed on the inner side of each of the bed legs. Each of the lifting racks is a hollow cylindrical rigid structure, formed with a long hole on the inner side, and inserted into a corresponding one of the bed legs from the bottom up. The upper end of each of the lifting racks pins and fixes a corresponding one of the connector pins at the end socket through a corresponding one of the connector dowel pins, and the lower end fixes a corresponding one of the roller fixing blocks at the end socket through a corresponding one of the roller bayonets. Each of the roller fixing blocks is connected with a corresponding one of the rollers. Each of the connector is provided with a bayonet which supports a corresponding one of the bed legs and performs a damping role, and the bayonet is a spring.

The bed tail and the bed head have the same structure.

A motor gear connecting box which is mechanically connected to a motor is disposed at the bottom of the bed board. The motor gear connecting box is provided with a coupling connector. The coupling connector is in a state of being connected or disconnected with the pull rod.

The bed tail gear device is a bed tail gearbox or a handle-containing bed tail gearbox.

In the state in which the coupling connector is connected with the pull rod, the motor drives the pull rod to rotate through the motor gear connecting box so that a structure is formed, in which the bed head gearbox and the bed tail gear device which are disposed at the bed head or bed tail drive the bed head or the bed tail to ascend and descend respectively through the transmission systems in mechanical connection.

Each one of the transmission systems includes a support rod, a support rod pin, an internal-thread lifting head limiting pin, a cap, a spiral lifting rod, a screw rod limiting pin, an internal-thread sleeve, an internal-thread lifting head, a steel cable fixing screw, fixed sleeves, a sleeve opening, a steel cable, a steel cable roller dowel pin and steel cable rollers.

The spiral lifting rod is positioned between the upper and lower borders of the bed stand in a vertical way, and is formed with an H-shaped cylindrical cap at the end socket of the upper end; the cap supports the upper border; the lower end of the spiral lifting rod passes through the lower border and is mechanically connected to the bed head gearbox or the bed tail gear device.

The internal-thread sleeve is a standing round tube structure, symmetrically formed with two rectangular through-holes on the side wall; the side wall below the through-holes integrally extends outward; and the extending portion is an overall rectangular plate structure which is vertical to the axis; the rectangular plate structure is formed with two through-holes A along one diagonal line, and is formed with two screw holes along another diagonal line; a through-hole B is disposed between each of the through-holes A and each of the screw holes; the diameter of each of the through-holes B is smaller than the diameter of the corresponding one of the screw holes, and the through-hole B communicates with the corresponding one of the screw holes.

Support rods parallel to the axis of the spiral lifting rod are respectively disposed on two sides of the spiral lifting rod; the support rods pass through the through-holes A; the two ends of each of the support rods are respectively connected with the upper and lower borders of the bed stand in a riveted way; the spiral lifting rod is fixed with two screw rod limiting pins; and the screw rod limiting pins are respectively positioned between the internal-thread sleeve and the cap and between the internal-thread sleeve and the end socket of the lower end of the spiral lifting rod.

The internal-thread lifting head is a standing round tube structure, respectively provided with screw threads on the inner and outer walls; the internal-thread lifting head is located in the internal-thread sleeve; the internal screw threads are in spiral connection with the spiral lifting rod; the internal-thread lifting head limiting pins are respectively disposed at the upper and lower end faces of the internal-thread lifting head; and the internal-thread lifting head limiting pins are parallel to the axis of the internal-thread lifting head.

The sleeve opening is an arc-shaped plate structure, having an inner wall provided with internal screw threads at a screw pitch which is the same as that of the external screw threads of the internal-thread lifting head. The sleeve opening is embedded in the rectangular through-hole of the internal-thread sleeve and is in spiral connection with the external screw threads of the internal-thread lifting head.

The fixed sleeves are semi-round plate structures, wrapping the excircles of the internal-thread sleeve and the sleeve opening in pairs and being fastened and connected to form a round tube structure.

The plural steel cable rollers are uniformly distributed in the groove-shaped structure of the lower border of the bed stand and are pinned and fixed with the lower groove-shaped border through steel cable roller dowel pins.

The steel cable bypasses plural steel cable rollers; one end of the steel cable is connected with the connector dowel pin in a locked way, and the end socket of the other end is connected with the steel cable fixing screw in a fastened way; the steel cable fixing screw passes through the screw hole in the rectangular plate structure and is clamped at the corresponding one of through-holes B.

A structure is formed, in which the internal-thread sleeve integrally moves up and down on the spiral lifting rod, driving the extension and withdrawal of the steel cable, and then driving the lifting racks to move up and down through the steel cable.

The bed head gearbox includes a female bed head gearbox housing, a male bed head gearbox housing, a large shaft bushing A, a first small shaft bushing A, a second small shaft bushing A, a third small shaft bushing A, a first bearing shim A, a second bearing shim A, a third bearing shim A, a fourth bearing shim A, a first plane bearing A, a second plane bearing A, a first spring shim A, a second spring shim A, an open-end short shaft A, a first dowel pin A, a second dowel pin A, a first bevel gear A, a second bevel gear A, a limiting shim A, a closed-end long shaft A and a split pin A.

The female bed head gearbox housing and the male bed head gearbox housing are respectively integrally molded by injection. The female bed head gearbox housing and the male bed head gearbox housing are internally provided with first convex and concave spaces which face each other and are used for clamping and fixing components.

The first bevel gear A and the second bevel gear A are positioned in the first convex and concave spaces, and are in mutually vertical arrangement and in engaged connection.

The open-end short shaft A is vertically disposed, with a lower end coupled and fixed with the first bevel gear A and an upper end formed with an open slot which is mechanically connected with the transmission systems; the open-end short shaft A is provided with the first dowel pin A which limits and locks the first bevel gear A; the open-end short shaft A is sequentially annularly sleeved in the large shaft bushing A, the first small shaft bushing, A, the first bearing shim A, the first plane bearing A, the second bearing shim A and the first spring shim A which are limited by the first convex and concave spaces from the top down; and the first bearing shim A and the first plane bearing A and the second bearing shim A and the first spring shim A and the first bevel gear A are in compact compression and connection.

The closed-end long shaft A is horizontally arranged, coupled and fixed with the second bevel gear A; the closed-end long shaft A is provided with the second dowel pin A which limits and locks the second bevel gear A; one end of the closed-end long shaft A passes through the limiting shim A and the second small shaft bushing A which are limited by the first convex and concave spaces, and extends out, and the end socket is provided with a splitting pin A for being connected with the pull rod; the other end of the closed-end long shaft A is sequentially annularly sleeved in the third small shaft bushing A, the fourth bearing shim A, the second plane bearing A, the third bearing shim A and the second spring shim A which are limited by the first convex and concave spaces from the right to the left; and, the fourth bearing shim A and the second plane bearing A and the third bearing shim A and the second spring shim A and the second bevel gear A are in compact compression and connection.

The handle-containing bed tail gearbox includes a female bed tail gearbox housing, a male bed tail gearbox housing, a large shaft bushing B, a first small shaft bushing B, a second small shaft bushing B, a third small shaft bushing B, a first bearing shim B, a second bearing shim B, a third bearing shim B, a fourth bearing shim B, a first plane bearing B, a second plane bearing B, a first spring shim B, a second spring shim B, an open-end short shaft B, a first dowel pin B, a second dowel pin B, a first bevel gear B, a second bevel gear B, a long shaft, a split pin B and a handle.

The female bed tail gearbox housing and the male bed tail gearbox housing are respectively integrally molded by injection. The female bed tail gearbox housing and the male bed tail gearbox housing are internally provided with second convex and concave spaces which face each other and are used for clamping and fixing components.

The first bevel gear B and the second bevel gear B are positioned in the second convex and concave spaces, and are in mutually vertical arrangement and in engaged connection.

The open-end short shaft B is vertically disposed, with a lower end coupled and fixed with the first bevel gear B and an upper end formed with an open slot which is mechanically connected with the transmission systems; the open-end short shaft B is provided with the first dowel pin B which limits and locks the first bevel gear B; the open-end short shaft B is sequentially annularly sleeved in the large shaft bushing B, the first small shaft bushing B, the first bearing shim B, the first plane bearing B, the second bearing shim B and the first spring shim B which are limited by the second convex and concave spaces from the top down; and the first bearing shim B and the first plane bearing B and the second bearing shim B and the first spring shim B and the first bevel gear B are in compact compression and connection.

The long shaft B is horizontally arranged, coupled and fixed with the second bevel gear B; the long shaft B is provided with the second dowel pin B which limits and locks the second bevel gear B; one end of the long shaft B passes through the third small shaft bushing B which is limited by the second convex and concave spaces, and extends out, and the end socket is provided with an open slot and is fixedly connected with the handle through the open slot.

The other end of the long shaft B is sequentially annularly sleeved in the second spring shim B, the fourth bearing shim B, the second plane bearing B, the third bearing shim B and the second small shaft bushing B which are limited by the second convex and concave spaces from the right to the left, and extends out of the second convex and concave spaces; the end socket of the other end of the long shaft B is provided with the split pin B for being connected with the pull rod; and the second spring shim B and the fourth bearing shim B and the second plane bearing B and the third bearing shim B and the second bevel gear B are in compact compression and connection.

The handle includes a handle fixing screw, a grip dowel pin, grip shims, a grip spring, a grip bolt, a grip and a grip connector; the handle wall of the handle is a cylindrical rigid structure; the end socket of one end of the handle wall is provided with an annular connecting portion in an integrated or fastened way; the grip connector is sunk in the annular connecting portion and is connected with the annular connecting portion in a fastened way through the handle fixing screw; and the end socket of the other end of the handle wall of the handle is formed with a groove or a recessed portion.

The grip connector is integrally columnar; one end is provided with a projecting portion; and the projecting portion is inserted in the open slot formed on the long shaft B and forms an interlocking structure.

The grip is a hollow cylindrical structure, internally inserted with the grip bolt. The grip bolt is annularly sleeved with the grip spring which is held by two grip shims. The end socket of one end of the grip bolt is inserted into the groove which is formed at the end socket of the other end of the handle wall of the handle and is connected in a riveted way through the grip dowel pin. The end socket of the other end of the grip bolt is provided with a limiting portion which limits the slide-out of the grip.

The bed tail gearbox includes a female bed tail gearbox housing, a male bed tail gearbox housing, a large shaft bushing C, a first small shaft bushing C, a second small shaft bushing C, a third small shaft bushing C, a first bearing shim C, a second bearing shim C, a third bearing shim C, a fourth bearing shim C, a first plane bearing C, a second plane bearing C, a first spring shim C, a second spring shim C, an open-end short shaft C, a first dowel pin C, a second dowel pin C, a first bevel gear C, a second bevel gear C, a long shaft C, a split pin C and a limiting shim C.

The female bed tail gearbox housing and the male bed tail gearbox housing are respectively integrally molded by injection. The female bed tail gearbox housing and the male bed tail gearbox housing are internally provided with second convex and concave spaces which face each other and are used for clamping and fixing components.

The first bevel gear C and the second bevel gear C are positioned in the second convex and concave spaces, and are in mutually vertical arrangement and in engaged connection.

The open-end short shaft C is vertically disposed, with a lower end coupled and fixed with the first bevel gear C and an upper end formed with an open slot which is mechanically connected with the transmission systems; the open-end short shaft C is provided with the first dowel pin C which limits and locks the first bevel gear C; the open-end short shaft C is sequentially annularly sleeved in the large shaft bushing C, the first small shaft bushing C, the first bearing shim C, the first plane bearing C, the second bearing shim C and the first spring shim C which are limited by the second convex and concave spaces from the top down; and the first bearing shim C and the first plane bearing C and the second bearing shim C and the first spring shim C and the first bevel gear C are in compact compression and connection.

The long shaft C is horizontally arranged, coupled and fixed with the second bevel gear C. The long shaft C is provided with the second dowel pin C which limits and locks the second bevel gear C. One end of the long shaft C passes through the limiting shim C and the third small shaft bushing C which are limited by the second convex and concave spaces, and has the end socket which is provided with an open slot.

The other end of the long shaft C is sequentially annularly sleeved in the second spring shim C, the fourth bearing shim C, the second plane bearing C, the third bearing shim C and the second small shaft bushing C which are limited by the second convex and concave spaces from the right to the left, and extends out of the second convex and concave spaces; the end socket of the other end of the long shaft C is provided with the split pin C for being connected with the pull rod; and the second spring shim C and the fourth bearing shim C and the second plane bearing C and the third bearing shim C and the second bevel gear C are in compact compression and connection.

The motor gear connecting box includes a female connecting box housing, a male connecting box housing, a short motor shaft, a coupling long shaft E, a first small shaft bushing E, a third small shaft bushing E, a first limiting shim E, a second limiting shim E, a first bevel gear E, a second bevel gear E, a first split pin E, a second split pin E, a first dowel pin E, a second dowel pin E, a first spring shim E, a third split pin E, a first bearing shim E, a second spring shim E, a first plane bearing E, a third bearing shim E, a second bearing shim E, a second plane bearing E, a second small shaft bushing E, a fourth bearing shim E, a fourth small shaft bushing E, a coupling connector spring and a coupling connector.

The female connecting box housing and the male connecting box housing are respectively integrally molded by injection. The female connecting box housing and the male connecting box housing are internally provided with third convex and concave spaces which face each other and are used for clamping and fixing components.

The first bevel gear E and the second bevel gear E are positioned in the third convex and concave spaces, and are in mutually parallel arrangement and in engaged connection.

The short motor shaft is horizontally arranged, coupled and fixed with the first bevel gear E; the short motor shaft is provided with the first dowel pin E which limits and locks the first bevel gear E. One end of the short motor shaft passes through the first limiting shim E and the first small shaft bushing E which are limited by the third convex and concave spaces, and extends out of the third convex and concave spaces, and the end socket is formed with a pin hole in which the first split pin E is inserted. The other end of the short motor shaft is sequentially annularly sleeved in the first spring shim E, the first bearing shim E, the first plane bearing E, the second bearing shim E and the second small shaft bushing E which are limited by the third convex and concave spaces from the left to the right. The first bevel gear E and the first spring shim E and the first bearing shim E and the first plane bearing E and the second bearing shim E are in compact compression and connection.

The coupling long shaft E is horizontally arranged, coupled and fixed with the second bevel gear E. The coupling long shaft E is provided with the second dowel pin E which limits and locks the second bevel gear E. One end of the coupling long shaft E passes through the second limiting shim E and the third small shaft bushing E which are limited by the third convex and concave spaces, and extends out of the third convex and concave spaces, and the end socket is formed with a pin hole in which the second split pin E is inserted. The other end of the coupling long shaft E is sequentially annularly sleeved in the second spring shim E, the third bearing shim E, the second plane bearing E, the fourth bearing shim E and the fourth small shaft bushing E which are limited by the third convex and concave spaces from the left to the right. The second bevel gear E and the second spring shim E and the third bearing shim E and the second plane bearing E and the fourth bearing shim E are in compact compression and connection; the other end of the coupling long shaft E extends and gets out of the third convex and concave spaces, and the end socket is formed with a pin hole in which the third split pin E is inserted. The coupling connector is an integrally hollow cylindrical structure which is square outside and round inside, having slot holes on the lateral side; one end of the coupling connector is inserted into the coupling long shaft E, and the other end is formed with a pin slot opening at the end socket. The coupling connector is in pin connection with the other end or right end of the coupling long shaft E through the third split pin E; and the coupling connector is internally provided with the coupling connector spring.

According to the technical solution of the present invention, the bed head and the bed tail are respectively provided with the bed head gearbox and the bed tail gearbox which are mechanically connected with transmission systems respectively disposed in the bed head or bed tail; meanwhile, the bed head gearbox and the bed tail gearbox are connected through a pull rod to form a entire transmission; when driven to rotate by a motor or a handle, the pull rod can bring bed feet which are connected with the transmission system to move vertically, thus realizing the vertical movement of the whole bed. The present invention has the advantages of compact structure, comprehensive functions, energy conservation, and flexible and convenient operation.

Figure 1:
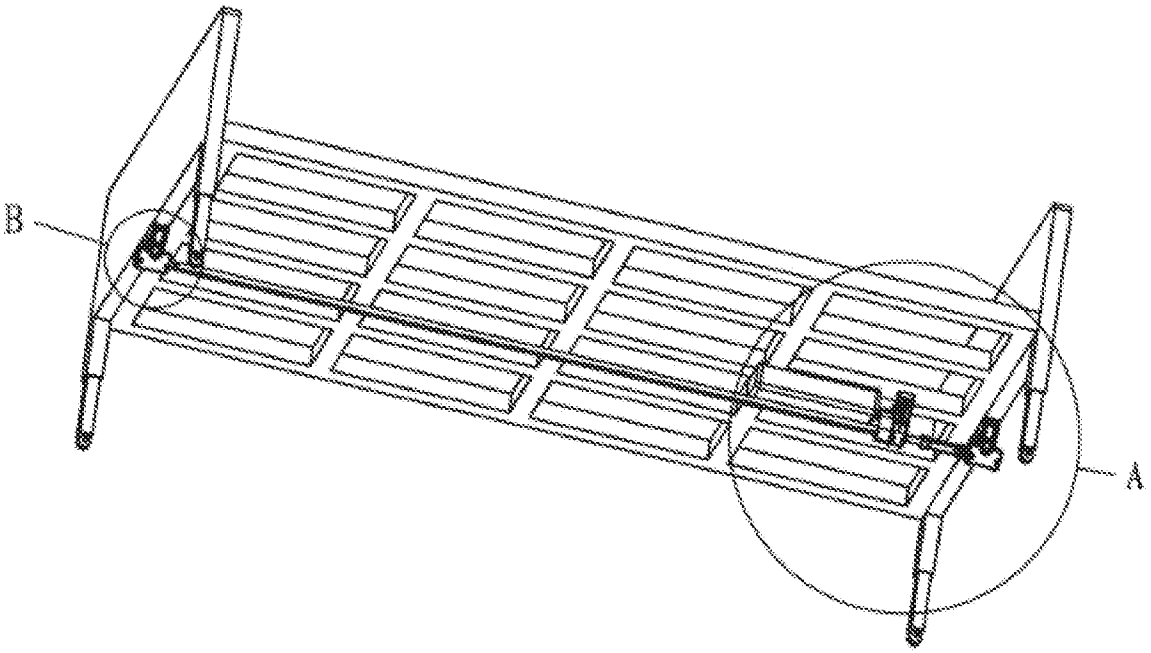
FIG. 1 is a schematic view of an overall structure of the present invention.
Figure 2:
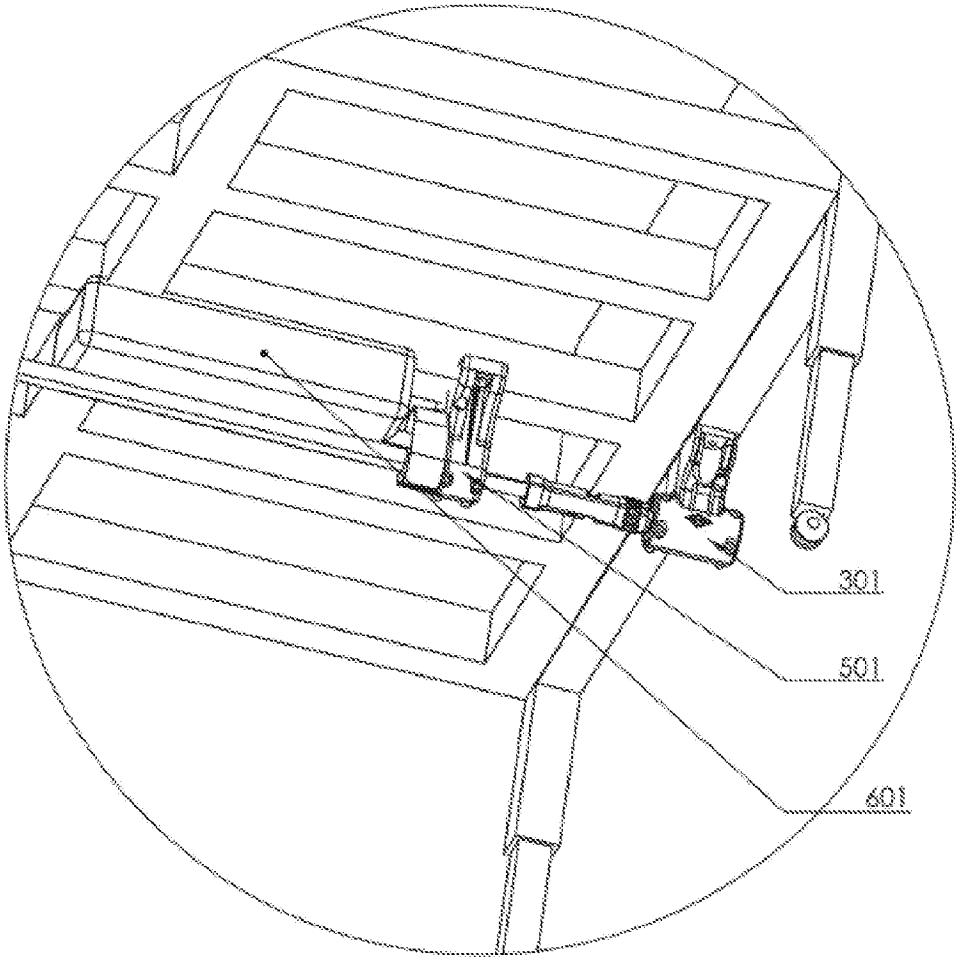
FIG. 2 is a partially enlarged view of part A in a bed tail in FIG. 1.
Figure 3:
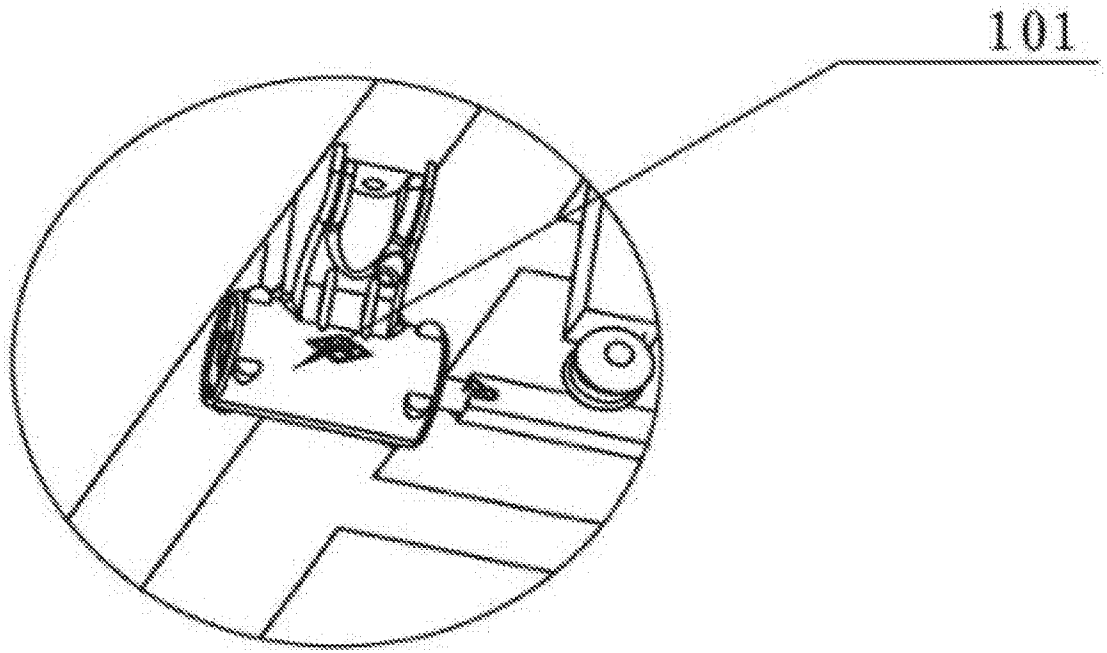
FIG. 3 is a partially enlarged view of part B in a bed head in FIG. 1.
Figure 4:
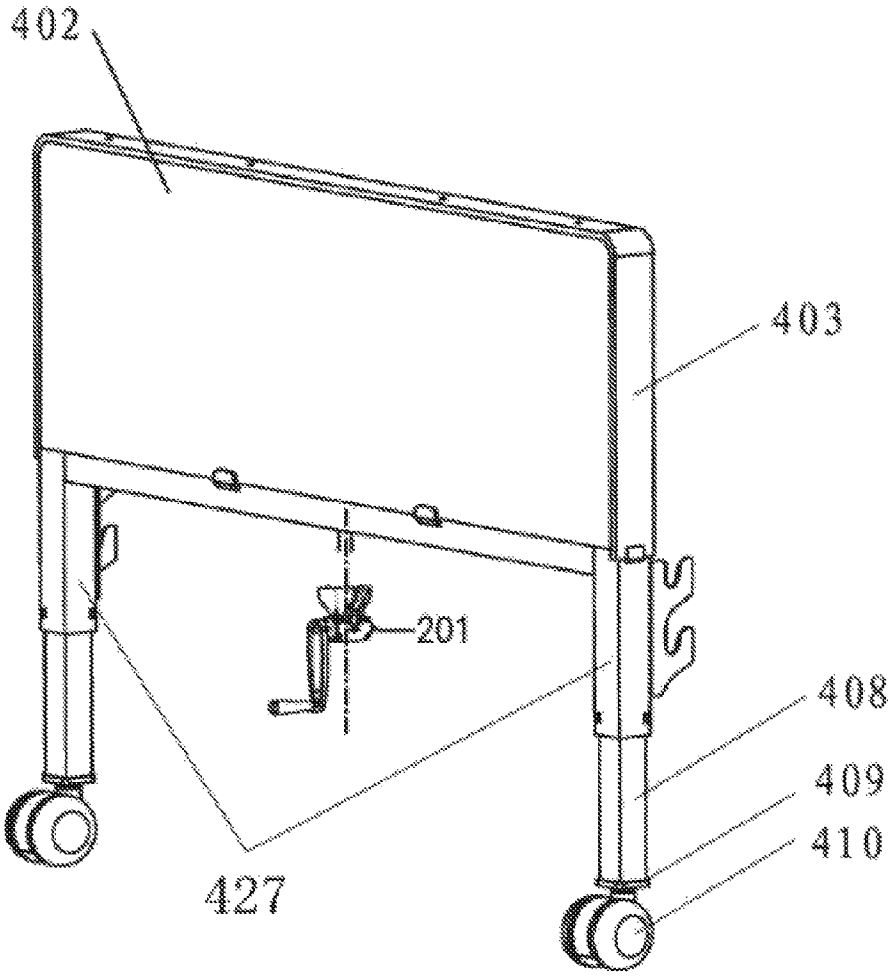
FIG. 4 is a schematic view of an appearance structure of the bed tail of the present invention.

| | |
|---|---|
| 101. Bed head gearbox | 102. Female bed head gearbox housing |
| 104. Large shaft bushing A | 103. Male bed head gearbox housing |
| 1051. First small shaft bushing A | 1052. Second small shaft bushing A |
| 1053. Third small shaft bushing A | 1061. First bearing shim A |
| 1062. Second bearing shim A | 1063. Third bearing shim A |
| 1064. Fourth bearing shim A | 1071. First plane bearing A |
| 1072. Second plane bearing A | 1081. First spring shim A |
| 1082. Second spring shim A | 109. Open-end short shaft A |
| 1101. First dowel pin A | 1102. Second dowel pin A |
| 1111. First bevel gear A | 1112. Second bevel gear A |
| 112. Limiting shim A | 113. Closed-end long shaft A |
| 114. Split pin A | 201. Handle-containing bed tail gearbox |
| 202. Female bed tail gearbox housing | 203. Male bed tail gearbox housing |
| 204. Large shaft bushing B | 2051. First small shaft bushing B |
| 2052. Second small shaft bushing B | 2053. Third small shaft bushing B |
| 2061. First bearing shim B | 2062. Second bearing shim B |
| 2063. Third bearing shim B | 2064. Fourth bearing shim B |
| 2071. First plane bearing B | 2072. Second plane bearing B |
| 2081. First spring shim B | 2082. Second spring shim B |
| 209. Open-end short shaft B | |
| 2101. First dowel pin B | 2102. Second dowel pin B |
| 2111. First bevel gear B | 2112. Second bevel gear B |
| 212. Long shaft B | 213. Split pin B |
| 223. Handle fixing screw | 224. Handle |
| 225. Grip dowel pin | 226. Grip shim |
| 227. Grip spring | 228. Grip bolt |
| 229. Grip | 230. Grip connector |
| 301. Bed tail gearbox | 304. Large shaft bushing C |
| 3051. First small shaft bushing C | 3052. Second small shaft bushing C |
| | 3053. Third small shaft bushing C |
| 3061. First bearing shim C | 3062. Second bearing shim C |
| 3063. Third bearing shim C | 3064. Fourth bearing shim C |
| 3071. First plane bearing C | 3072. Second plane bearing C |
| 3081. First spring shim C | 3082. Second spring shim C |
| 309. Open-end short shaft C | |
| 3101. First dowel pin C | 3102. Second dowel pin C |

-continued

| Description of marks in the drawings: | |
|---|---|
| 3111. First bevel gear C | 3112. Second bevel gear C |
| 312. Long shaft C | 313. Split pin C |
| 314. Limiting shim C | |
| 401. Transmission system | |
| 402. Bed head board | 403. Bed head frame |
| 404. Roller bayonet | 405. Bayonet |
| 406. Connector | 407. Connector dowel pin |
| 408. Lifting rack | 409. Roller fixing block |
| 410. Roller | 411. Bed head frame fixing screw |
| 412. Support rod | 413. Support rod pin |
| 414. Internal-thread lifting head limiting pin | 415. Cap |
| 416. Spiral lifting rod | 417. Screw rod limiting pin |
| 418. Internal-thread sleeve | |
| 420. Internal-thread lifting head | 421. Steel cable fixing screw |
| 422. Fixed sleeve | 423. Sleeve opening |
| 424. Steel cable | 425. Steel cable roller fixing pin |
| 426. Steel cable roller | 501. Motor gear connecting box |
| 502. Female connecting box housing | 503. Male connecting box housing |
| 504. Short motor shaft | 505. Coupling long shaft E |
| 5041. First small shaft bushing E | 5051. Third small shaft bushing E |
| 5042. First limiting shim E | 5052. Second limiting shim E |
| 5043. First bevel gear E | 5053. Second bevel gear E |
| 5044. First split pin E | 5054. Second split pin E |
| 5045. First dowel pin E | 5055. Second dowel pin E |
| 5046. First spring shim E | 5056. Third split pin E |
| 5047. First bearing shim E | 5057. Second spring shim E |
| 5048. First plane bearing E | 5058. Third bearing shim E |
| 5049. Second bearing shim E | 5059. Second plane bearing E |
| 50410. Second small shaft bushing E | 50510. Fourth bearing shim E |
| 50511. Fourth small shaft bushing E | 506. Coupling connector spring |
| 507. Coupling connector | 601. Motor |

DETAILED DESCRIPTION OF THE INVENTION

The technical solution of the present invention is described below in further detail in accompanying with the attached drawings.

As shown in FIGS. 1, 2, 3 and 4, a medical rehabilitation bed includes a bed head, a bed tail and a bed board, wherein a pull rod is arranged at the bottom of the bed board. The pull rod can be arranged at the center of the bottom of the bend board. The pull rod is a rod-like structure or a solid rod-like structure, with one end mechanically connected to a bed head gearbox 101 which is arranged at the bed head, and the other end mechanically connected to a bed tail gear device which is arranged at the bed tail. Transmission systems 401 having the same structure and capable of controlling the bed head and the bed tail to ascend and descend are respectively arranged in the bed head and the bed tail. The transmission systems 401 are mechanically connected to the bed head gearbox 101 and the bed tail gear device, respectively. The bed tail gear device is a bed tail gearbox 301 or a handle-containing bed tail gearbox 201.

The bed head includes a bed stand 428, bed head board 402, a bed head frame 403, roller bayonets 404, bayonets 405, connectors 406, connector dowel pin 407, lifting racks 408, roller fixing blocks 409 and rollers 410.

The bed stand 428 is a dual-leg upper-lower framework structure. The bed head frame 403 is processed as a groove-shaped rigid lath structure (namely a bottom-open groove-shaped structure which is formed by bending two ends at an angle of 90 DEG toward the same direction along the same lateral face of the lath), and is fixed at the upper border 429 of the bed stand 428 through plural bed head frame fixing screws 411.. The upper border 429 of the bed stand 428 is a bottom-open groove-shaped structure (or the cross section of the upper border 429 is a bottom-open groove-shaped structure). The lower border of the bed stand 428 is a top-open groove-shaped structure (or the cross section of the lower border is a top-open groove-shaped structure). The two ends of the lower border are respectively in fastening connection (for example, welded connection) with the two legs 427 of the bed stand 428. The bed head board 402 is a rigid plate structure, fixed at the upper and lower borders of the bed stand 428 on two sides through plural bed head frame fixing screws 411.

Bed legs 427 are hollow cylindrical rigid structures. A long hole is formed on the inner side of each of the bed legs 427. Each of the lifting racks 408 is a hollow cylindrical rigid structure, formed with a long hole on the inner side, and inserted into a corresponding bed leg 427 such that the long hole of the bed leg 427 and the long hole of the lifting rack are positioned on the same side and run through each other. The upper end of each of the lifting racks 408 pins and fixes a corresponding one of the connectors 406 at the end socket through a corresponding one of the connector dowel pins 407, and the lower end fixes a corresponding one of the roller fixing blocks 409 at the end socket through a corresponding one of the roller bayonets 404. Each of the roller fixing blocks 409 is connected with a corresponding one of the rollers 410. Each of the connectors 406 is provided with a bayonet 405 which supports a corresponding one of the bed legs 427 (inner side) and performs a damping role, and the bayonet 405 is a spring.

The bed tail and the bed head have the same structure.

A motor gear connecting box 501 which is mechanically connected to a motor 601 is disposed at the bottom of the bed board. The motor 601 can be fixed at the bottom of the bed board. The motor gear connecting box 501 is provided with a coupling connector 507. The coupling connector 507 is in a state of being connected or disconnected with the pull rod, which means that, by such configuration, the motor can be used to drive the pull rod to rotate (namely connected state), or the motor is not used to drive the pull rod to rotate (namely the disconnected state), and the handle is rotated to drive the pull rod to rotate.

In the state in which the coupling connector 507 is connected with the pull rod, the motor 601 drives the pull rod to rotate through the motor gear connecting box 501 so that a structure is formed, in which the bed head gearbox 101 and the bed tail gear device which are disposed at the bed head or bed tail drive the bed head or the bed tail to ascend and descend respectively through the transmission systems 401 in mechanical connection.

Figure 5A:
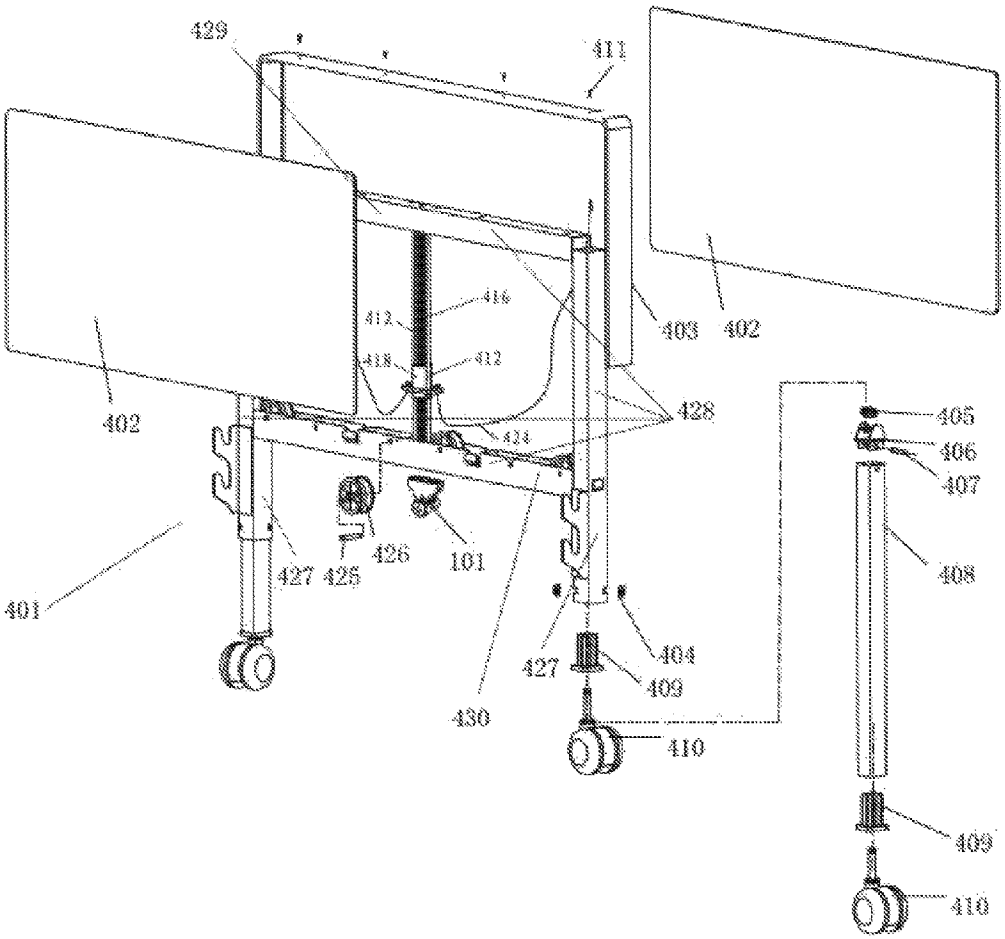
FIG. 5*a* is a schematic view of an assembling structure of a lifting device of the present invention.
Figure 5B:
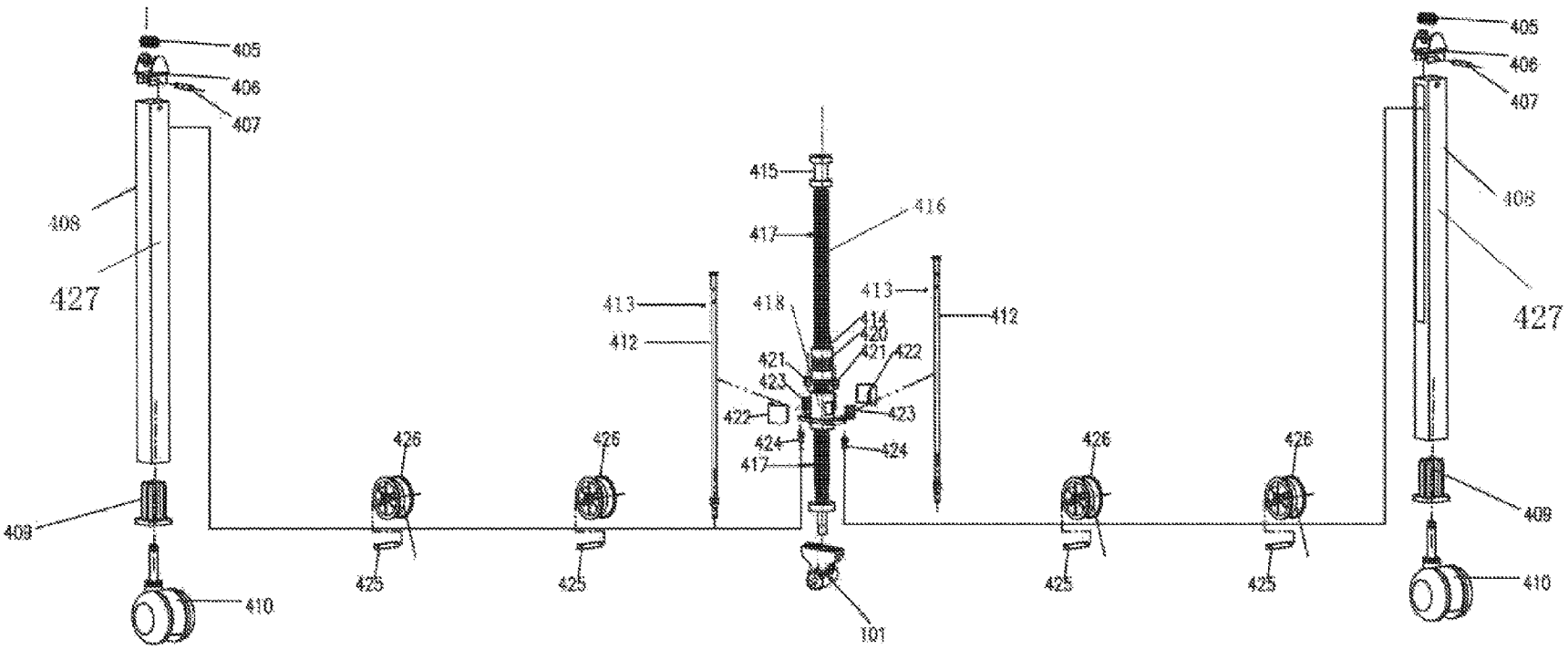
FIG. 5*b* is an exploded view of the structure of the lifting device of the present invention.
Figure 5C:
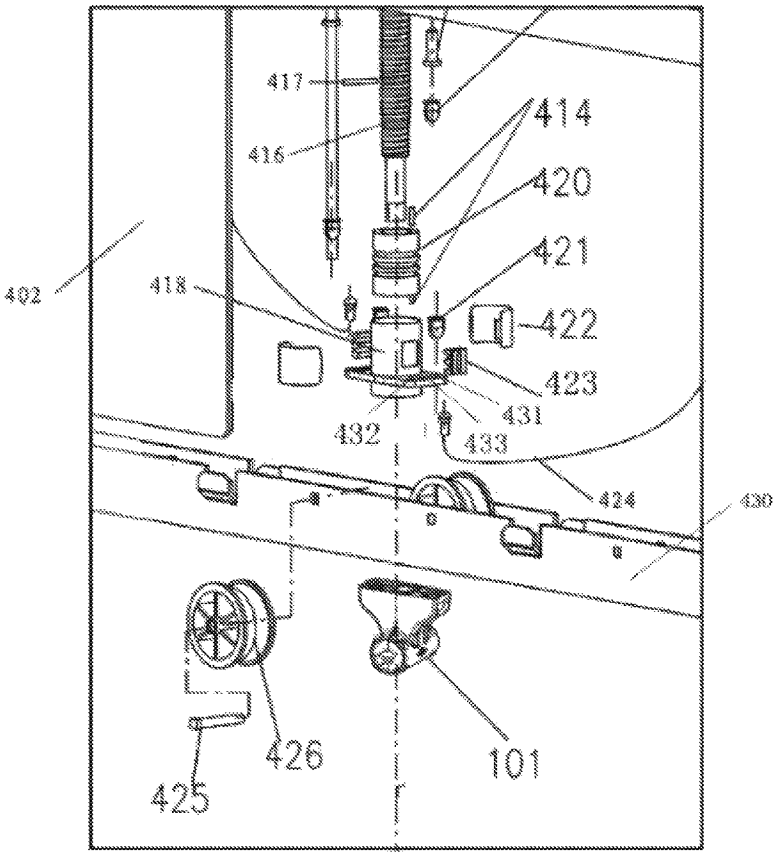
FIG. 5*c* is an exploded view of a partial structure of the lifting device of the present invention.

As shown in FIGS. 5*a*, 5*b* and 5*c*, each one of the transmission systems 401 includes a support rod 412, a support rod pin 413, an internal-thread lifting head limiting pin 414, a cap 415, a spiral lifting rod 416, a screw rod limiting pin 417, an internal-thread sleeve 418, an internal-thread lifting head 420, a steel cable fixing screw 421, fixed sleeves 422, a sleeve opening 423, a steel cable 424, a steel cable roller dowel pin 425 and steel cable rollers 426.

The spiral lifting rod 416 is positioned between the upper and lower borders of the bed stand 428 in a vertical way, and is formed with an H-shaped cylindrical cap 415 at the end socket of the upper end. The cap 415 supports or supports and fixes the upper border 429. The lower end of the spiral lifting rod 416 passes through the lower border 430 and is mechanically connected to the bed head gearbox 101 or the bed tail gear device, for example mechanical coupling connection.

The internal-thread sleeve 418 is a standing round tube structure, symmetrically formed with two rectangular or square through-holes on the side wall; the side wall below the through-holes integrally extends outward; and the extending portion is an overall rectangular plate structure which is vertical to the axis of the internal-thread sleeve 418. The rectangular plate structure is formed with two through-holes A 432 along one diagonal line (which means that the rectangular plate structure is provided with two through-holes A 432 which are symmetric to the diagonal line), and is formed with two screw holes 431 along another diagonal line. A through-hole B 433 is disposed between each one of the through-holes A 432 and each one of the screw holes 431. In this way, the two symmetric sides of the rectangular plate structure respectively have a through-hole A 432, a through-hole B 433 and a screw hole. The diameter of each of the through-holes B 433 is smaller than the diameter of the corresponding one of the screw holes 431, and the through-hole B 433 communicates with the corresponding one of the screw holes 431. The purpose of such configuration is as follows: the steel cable fixing screw 421 which is fixed at the steel cable 424 passes through the larger screw hole and then enters the smaller through-hole B 433 via a channel which communicates with the screw hole such that the steel cable fixing screw 421 is clamped and fixed at the through-hole B 433, and then a screw is screwed into the screw hole to fasten the steel cable fixing screw 421 without slipping; further speaking, such structure firmly fixes the steel cable 424 at the internal-thread sleeve 418.

Support rods 412 parallel to the axis of the spiral lifting rod 416 are respectively disposed on two sides of the spiral lifting rod 416. The support rods 412 pass through the through-holes A 432. The two ends of each of the support rods 412 are respectively connected with the upper and lower borders 430 of the bed stand 428 in a riveted way. One purpose of configuring the support rods 412 is to strengthen the overall firmness of the spiral lifting rod 416, and the other purpose is to provide the support rods 412 as guide columns, which facilitates the vertical movement of the internal-thread sleeve 418 on the spiral lifting rod 416 to play a supporting function. The spiral lifting rod 416 is fixed with two screw rod limiting pins 417. The screw rod limiting pins 417 are respectively positioned between the internal-thread sleeve 418 and the cap 415 and between the internal-thread sleeve 418 and the end socket of the lower end of the spiral lifting rod 416. Actually, the upper and lower two screw rod limiting pins 417 disposed at the spiral lifting rod 416 play the role of limiting the upper dead point position and lower dead point position when the internal-thread sleeve 418 moves on the spiral lifting rod 416.

The internal-thread 420 is a standing round tube structure, respectively provided with screw threads on the inner and outer walls. The internal-thread lifting head 420 is located in the internal-thread sleeve 418. The internal screw threads are in spiral connection with the spiral lifting rod 416. Internal-thread lifting head limiting pins 414 are respectively disposed at the upper and lower end faces of the internal-thread lifting head 420. The internal-thread lifting head limiting pins 414 are parallel to the axis of the internal-thread lifting head 420. The internal-thread lifting head limiting pins 414 are disposed in a way of protruding the upper end face or lower end face of the internal-thread lifting head 420. When the internal-thread lifting head limiting pin 414 at the upper end face moves to the upper dead point position along with the internal-thread sleeve 418, the screw rod limiting pin 417 disposed at the upper part stops the rotation of the internal-thread lifting head limiting pin 414, further stopping the upward movement of the internal-thread sleeve 418. Likewise, when the internal-thread lifting head limiting pin 414 at the lower end face moves to the lower dead point position along with the internal-thread sleeve 418, the screw rod limiting pin 417 disposed at the lower part stops the rotation of the internal-thread lifting head limiting pin 414, further stopping the downward movement of the internal-thread sleeve 418.

The sleeve opening 423 is an arc-shaped plate structure, having an inner wall provided with internal screw threads at a screw pitch which is the same as that of the external screw threads of the internal-thread lifting head 420. The sleeve opening 423 is embedded in the rectangular through-hole of the internal-thread sleeve 418 and is in spiral connection with the external screw threads of the internal-thread lifting head 420.

The fixed sleeves 422 are semi-round plate structures, wrapping the excircles of the internal-thread sleeve 418 and the sleeve opening 423 in pairs and being fastened and connected (for example through welding) to form a round tube structure.

The plural steel cable rollers 426 are uniformly distributed in the groove-shaped structure of the lower border 430 of the bed stand 428 and are pinned and fixed with the lower groove-shaped border through steel cable roller dowel pins 425. For example, two steel cable rollers 426 are respectively disposed on each one of the left and right sides of a spiral lifting center 416 which serves as the center, and the external two steel cable rollers 426 are located at positions of the lower border 430 respectively connected with a bed leg 427, as shown in FIG. 5*b*.

The steel cable 424 bypasses plural steel cable rollers 426, gets in via the long holes formed on the inner sides of each bed leg 427 and each corresponding lifting rack 408; one end (getting in the holes) of the steel cable is connected with the connector dowel pin 407 in a locked way, and the end socket of the other end is connected with the steel cable fixing screw 421 in a fastened way. The steel cable fixing screw 421 passes through the screw hole in the rectangular plate structure and is clamped at the corresponding one of through-holes B 433.

A structure is formed, in which the internal-thread sleeve 418 integrally moves up and down on the spiral lifting rod 416, driving the extension and withdrawal of the steel cable 424, and then driving the lifting racks 408 to move up and down through the steel cable 424.

Figure 6:
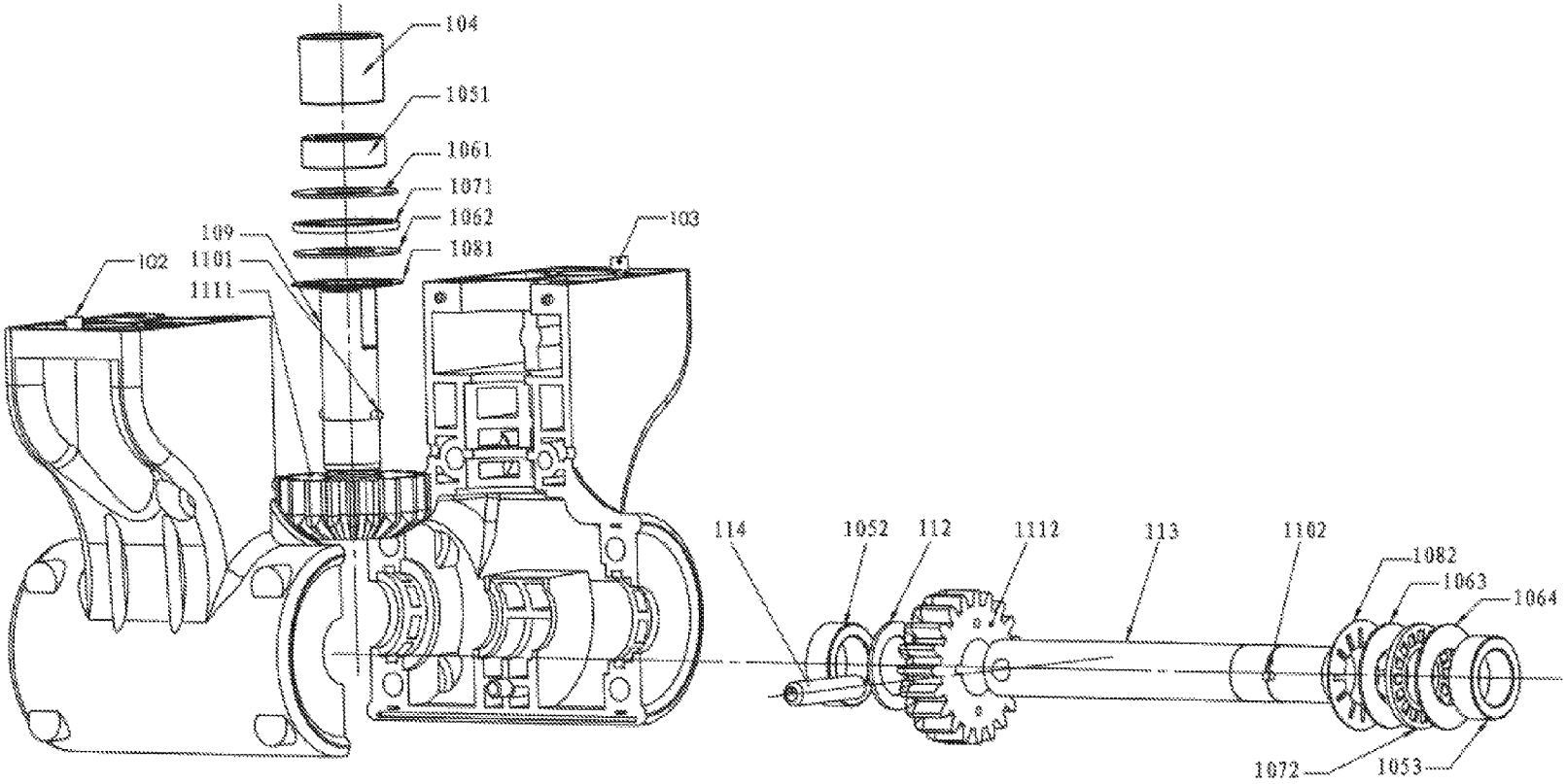
FIG. 6 is an exploded view of the structure of a bed head gearbox of the present invention.

As shown in FIG. 6, the bed head gearbox 101 includes a female bed head gearbox housing 102, a male bed head gearbox housing 103, a large shaft bushing A104, a first small shaft bushing A1051, a second small shaft bushing A1052, a third small shaft bushing A1053, a first bearing shim A1061, a second bearing shim A1062, a third bearing shim A1063, a fourth bearing shim A1064, a first plane bearing A1071, a second plane bearing A1072, a first spring shim A1081, a second spring shim A1082, an open-end short shaft A109, a first dowel pin A1101, a second dowel pin A1102, a first bevel gear A1111, a second bevel gear A1112, a limiting shim A112, a closed-end long shaft A113 and a split pin A114.

The female bed head gearbox housing 102 and the male bed head gearbox housing 103 are respectively integrally molded by injection, and after being folded, can enclose components inside to prevent slipping and misalignment. The female bed head gearbox housing 102 and the male bed head gearbox housing 103 are internally provided with first convex and concave spaces which face each other and are used for clamping and fixing components.

The convex and concave spaces refer to the interiors of the female bed head gearbox housing 102 and the male bed head gearbox housing 103 which are internally molded by injection according to the external size of each of the components to be limited such that the corresponding components are embedded therein, thus fulfilling the aim of fixing the components; the second convex and concave spaces and the third convex and concave spaces mentioned later are the same as the first convex and concave spaces and therefore are not further described.

The first bevel gear A1111 and the second bevel gear A1112 are positioned in the first convex and concave spaces, and are in mutually vertical arrangement and in engaged connection.

The so called mutually vertical (the first bevel gear A1111 and the second bevel gear A1112) arrangement and engaged connection refers to that the axes of the two bevel gears are vertical to each other and that the teeth of the bevel portions of the two bevel gears are mutually engaged. The mutually vertical arrangement and engaged connection of the first bevel gear B and the second bevel gear B and that of the first bevel gear C and the second bevel gear C are in a similar way.

The open-end short shaft A109 is vertically disposed, with a lower end coupled and fixed with the first bevel gear A1111 and an upper end formed with an open slot which is mechanically connected with the transmission systems 401. The open-end short shaft A109 is provided with the first dowel pin A1101 which limits and locks the first bevel gear A1111. The open-end short shaft A109 is sequentially annularly sleeved in the large shaft bushing A104, the first small shaft bushing A1051, the first bearing shim A1061, the first plane bearing A1071, the second bearing shim A1062 and the first spring shim A1081 which are limited by the the first convex and concave spaces from the top down.

The above top-to-bottom sequential loop overlapping is achieved in this way: the large shaft bushing A104 is closest to the upper open slot, below followed by the first small shaft bushing A1051, the first bearing shim A1061, the first plane bearing A1071, the second bearing shim A1062 and the first spring shim A1081 in turn.

The first bearing shim A1061 and the first plane bearing A1071 and the second bearing shim A1062 and the first spring shim A1081 and the first bevel gear A1111 are in compact compression and connection, representing that the five components can rotate synchronously (along with the open-end short shaft A109), which means that the first convex and concave spaces respectively independently limit the large shaft bushing A104 and the first small shaft bushing A1051, as shown in FIG. 6.

Figure 7:
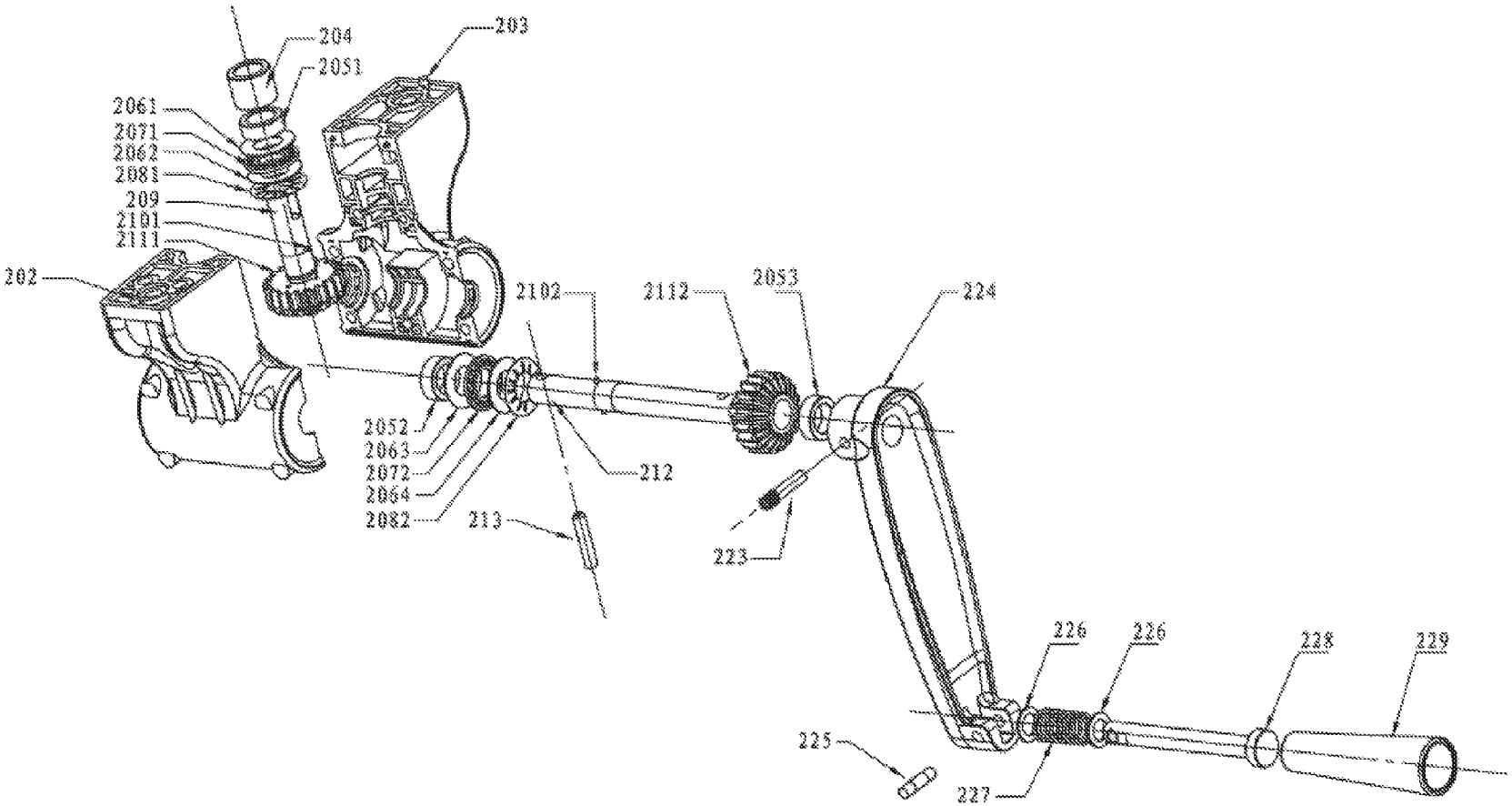
FIG. 7 is an exploded view of the structure of a handle-containing bed tail gearbox of the present invention.
Figure 8:
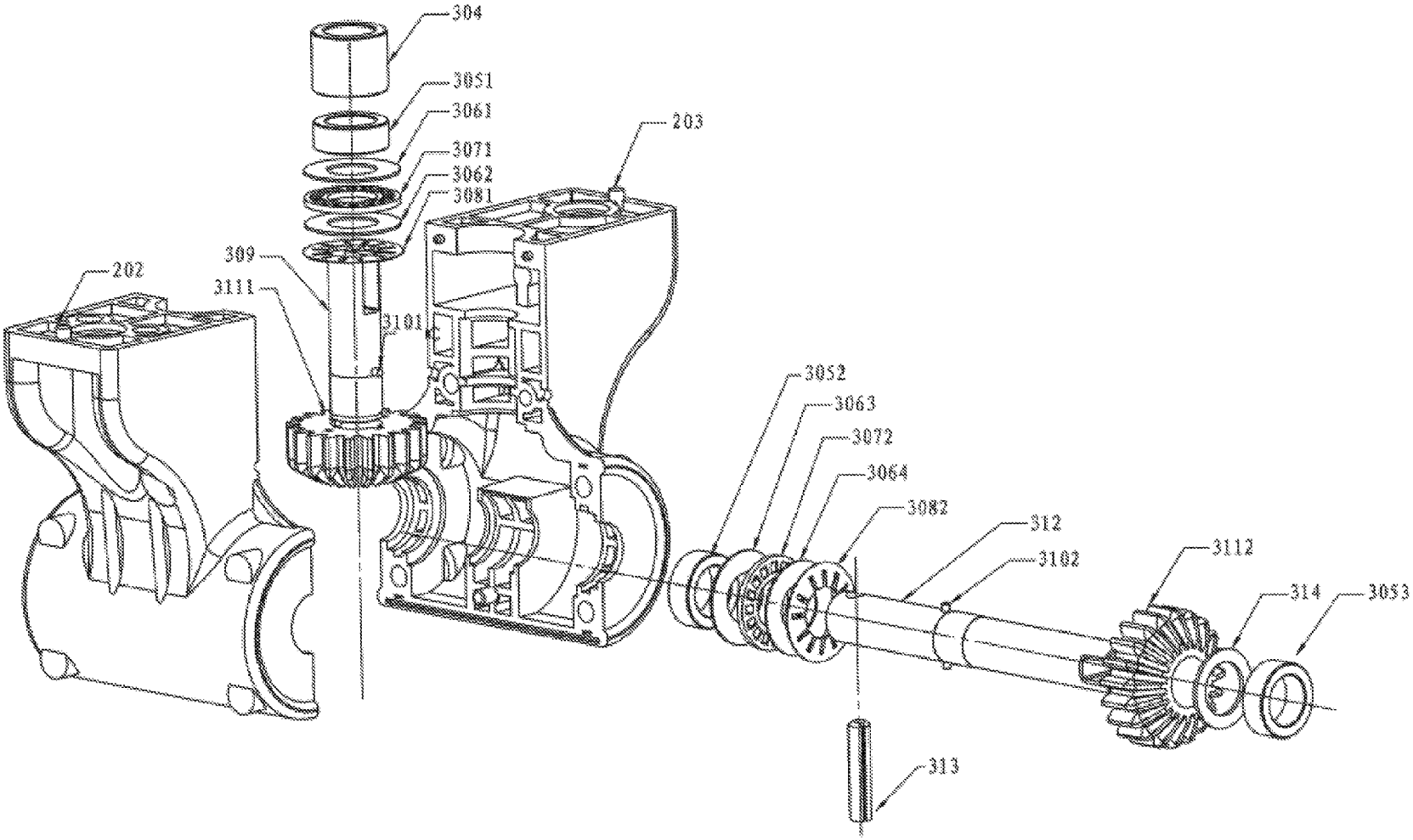
FIG. 8 is an exploded view of the structure of a bed tail gearbox without a handle of the present invention.
Figure 9:
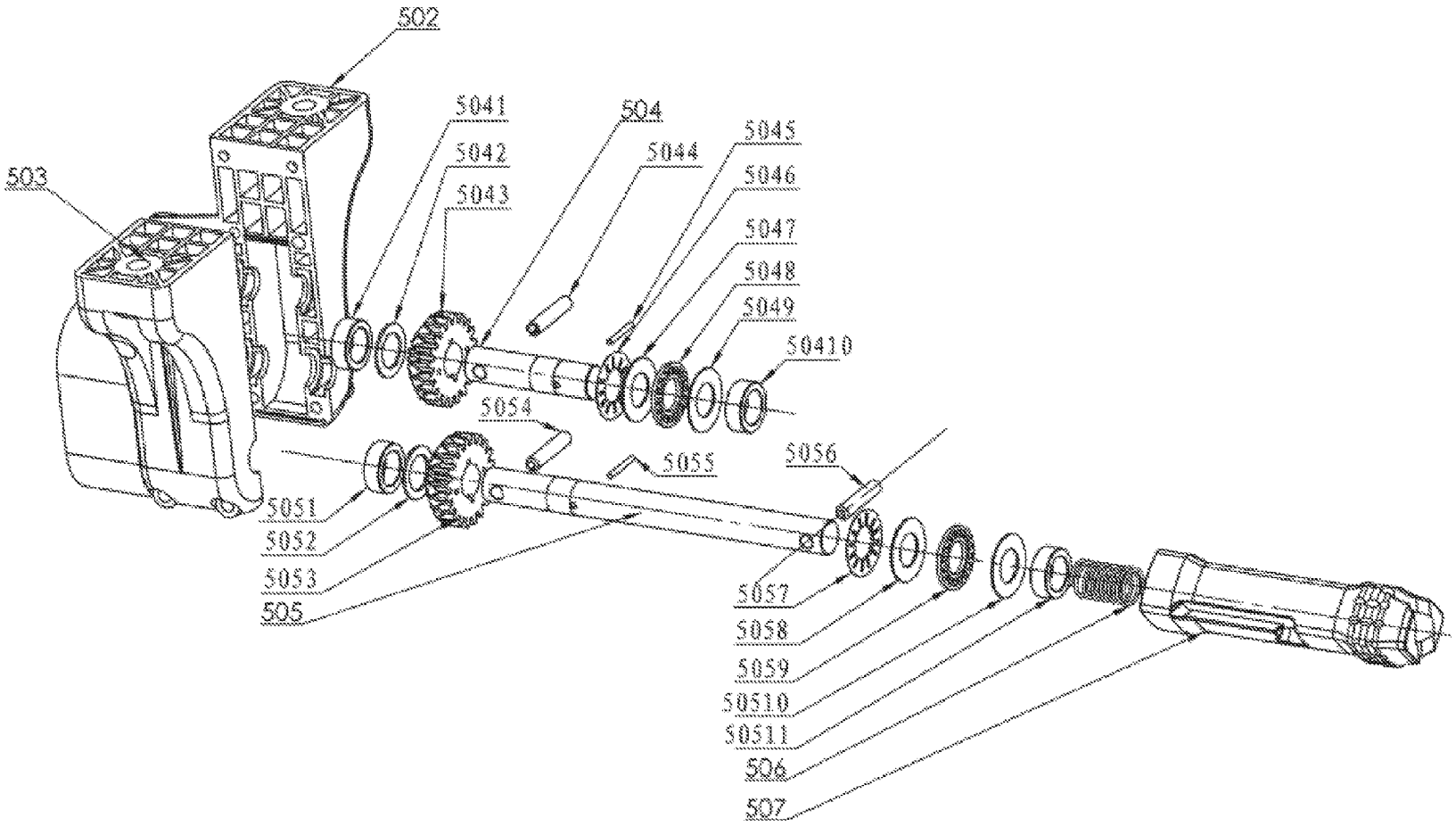
FIG. 9 is an exploded view of the structure of a motor gear connecting box of the present invention.

The closed-end long shaft A113 is horizontally arranged, coupled and fixed with the second bevel gear A1112. The closed-end long shaft A113 is provided with the second dowel pin A1102 which limits and locks the second bevel gear A1112. One end (for example, left end) of the closed-end long shaft A113 passes through the limiting shim A112 and the second small shaft bushing A1052 which are limited by the first convex and concave spaces, and extends out, and the end socket is provided with the split pin A114 for being connected with the pull rod. The other end (for example, right end) of the closed-end long shaft A113 is sequentially annularly sleeved in the third small shaft bushing A1053 (the third small shaft bushing A1053 is positioned at the most right end), the fourth bearing shim A1064, the second plane bearing A1072, the third bearing shim A1063 and the second spring shim A1082 which are limited by the first convex and concave spaces from the right to the left. The fourth bearing shim A1064 and the second plane bearing A1072 and the third bearing shim A1063 and the second spring shim A1082 and the second bevel gear A1112 are in compact compression and connection, which means that the five components can synchronize with the closed-end long shaft A113 during rotation. The first convex and concave spaces independently limit the third small shaft bushing A1053, as shown in FIG. 6. The small shaft bushing independently limited in the corresponding convex and concave spaces as shown in FIGS. 7, 8 and 9 can be explained and understood in a similar way. The corresponding large shaft bushing is also independently limited.

Figure 7A:
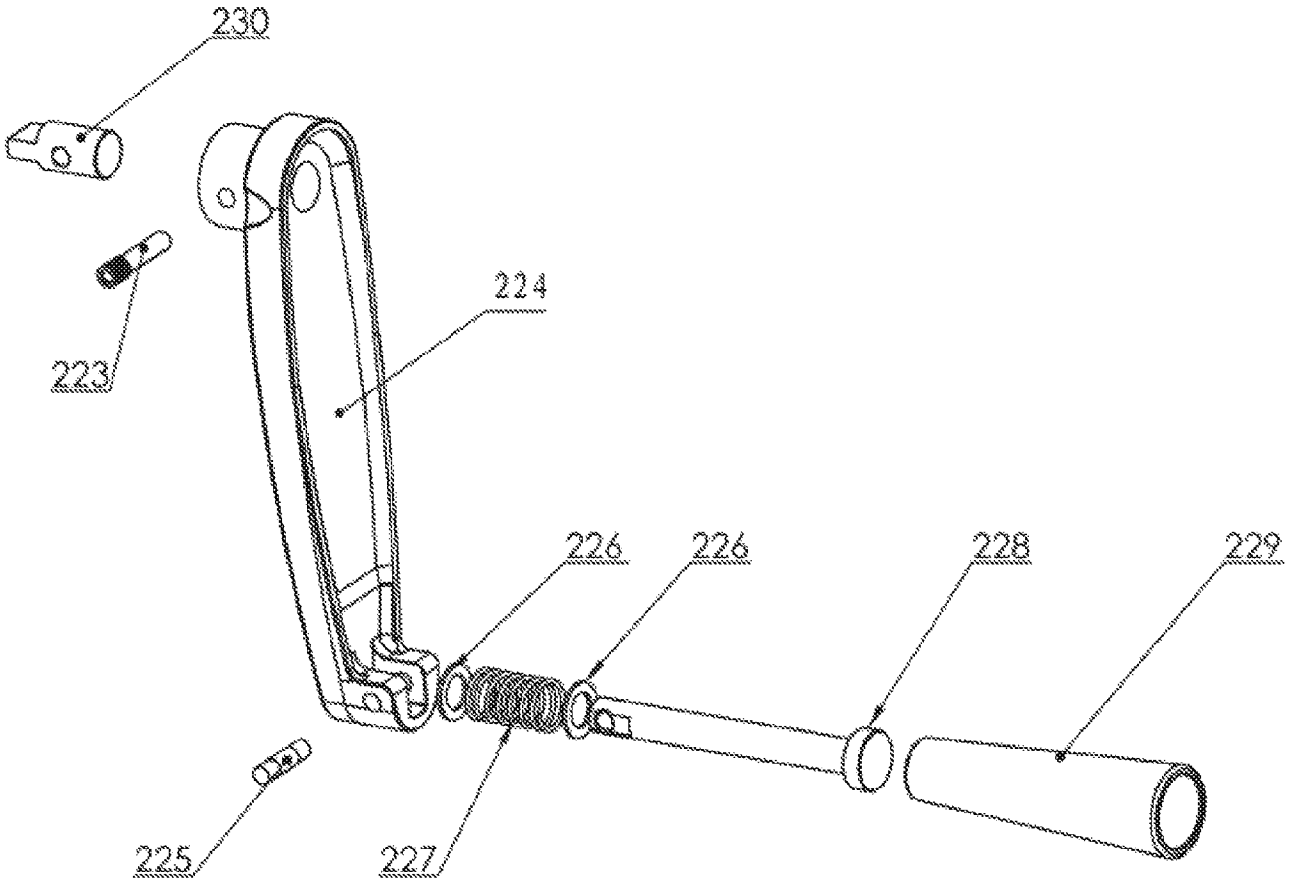
FIG. 7*a* is an exploded view of the structure of a handle portion in FIG. 7.

As shown in FIG. 7 and FIG. 7*a*, the handle-containing bed tail gearbox 201 includes a female bed tail gearbox housing 202, a male bed tail gearbox housing 203, a large shaft bushing B204, a first small shaft bushing B2051, a second small shaft bushing B2052, a third small shaft bushing B2053, a first bearing shim B2061, a second bearing shim B2062, a third bearing shim B2063, a fourth bearing shim B2064, a first plane bearing B2071, a second plane bearing B2072, a first spring shim B2081, a second spring shim B2082, an open-end short shaft B209, a first dowel pin B2101, a second dowel pin B2102, a first bevel gear B2111, a second bevel gear B2112, a long shaft B212, a split pin B213 and a handle 224.

The female bed tail gearbox housing 202 and the male bed tail gearbox housing 203 are respectively integrally molded by injection. The female bed tail gearbox housing 202 and the male bed tail gearbox housing 203 are internally provided with second convex and concave spaces which face each other and are used for clamping and fixing components.

The first bevel gear B2111 and the second bevel gear B2112 are positioned in the second convex and concave spaces, and are in mutually vertical arrangement and in engaged connection.

The open-end short shaft B209 is vertically arranged, with a lower end coupled and fixed (for example by means of interference fixing, others concerning coupling and fixing can be explained in this way) with the first bevel gear B2111 and an upper end formed with an open slot which is mechanically connected with the transmission system 401. The open-end short shaft B209 is provided with the first dowel pin B2101 which limits and locks the first bevel gear B2111. The open-end short shaft B209 is sequentially annularly sleeved in the large shaft bushing B204, the first small shaft bushing B2051, the first bearing shim B2061, the first plane bearing B2071, the second bearing shim B2062 and the first spring shim B2081 which are limited by the second convex and concave spaces from the top down (the large shaft bushing B204 is on the top, and the large shaft bushing B204 and the first small shaft bushing B2051 are respectively independently limited by the second convex and concave spaces. The so called limiting can be explained as position limiting). The first bearing shim B2061 and the first plane bearing B2071 and the second bearing shim B2062 and the first spring shim B2081 and the first bevel gear B2111 are in compact compression and connection, which means that the five components (including the first bevel gear B2111) synchronize with the open-end short shaft B209 during rotation.

The long shaft B212 is horizontally arranged, coupled and fixed with the second bevel gear B2112. The long shaft B212 is provided with the second dowel pin B2102 which limits and locks the second bevel gear B2112. One end (or right end) of the long shaft B212 passes through the third small shaft bushing B2053 which is limited by the second convex and concave spaces, and extends out, and the end socket is provided with an open slot and is fixedly connected with the handle 224 through the open slot.

The other end (left end) of the long shaft B212 is sequentially annularly sleeved in the second spring shim B2082, the fourth bearing shim B2064, the second plane bearing B2072, the third bearing shim B2063 and the second small shaft bushing B2052 which are limited by the second convex and concave spaces from the right to the left, and extends out of the second convex and concave spaces, which means that the second small shaft bushing B2052 is positioned at the most left end of the five components. The end socket of the other end (left end) of the long shaft B212 is provided with the split pin B213 for being connected with the pull rod. The second spring shim B2082 and the fourth bearing shim B2064 and the second plane bearing B2072 and the third bearing shim B2063 and the second bevel gear B2112 are in compact compression and connection, which means that the five components (the second spring shim B2082, the fourth bearing shim B2064, the second plane bearing B2072, the third bearing shim B2063 and the second bevel gear B2112) can synchronize with the long shaft B212 during rotation. The second small shaft bushing B2052 is independently limited by the second convex and concave spaces.

As shown in FIG. 7*a*, the handle 224 includes a handle fixing screw 223, a grip dowel pin 225, grip shims 226, a grip spring 227, a grip bolt 228, a grip 229 and a grip connector 230. The handle wall of the handle 224 is a cylindrical rigid structure; the end socket of one end of the handle wall is provided with an annular connecting portion in an integrated or fastened way. The grip connector 230 is sunk in the annular connecting portion and is connected with the annular connecting portion in a fastened way through the handle fixing screw 223. The end socket of the other end of the handle wall of the handle 224 is formed with a groove or a recessed portion.

The grip connector 230 is an integrally cylindrical or solid column; one end is provided with a projecting portion; and the projecting portion is inserted in the open slot formed on the long shaft B212 and forms an interlocking structure.

The grip 229 is a hollow cylindrical structure, internally inserted with the grip bolt 228. The grip bolt 228 is annularly sleeved with the grip spring 227 which is held by two grip shims 226. The end socket of one end of the grip bolt 228 is inserted into the groove or recession portion which is formed at the end socket of the other end of the handle wall of the handle 224 and is connected in a riveted way through the grip dowel pin 225. The end socket of the other end of the grip bolt 228 is provided with a limiting portion which limits the slide-out of the grip 229. In this way, when the grip 229 is rocked, the projecting portion formed on the grip connector 230 is inserted into the open slot of the long shaft B212 and forms an interlocking to drive the long shaft B212 to rotate, thus driving the transmission system 401 to ascend and descend the bed head or bed tail through the bevel gear.

As shown in FIG. 8, the bed tail gearbox 301 includes a female bed tail gearbox housing 202, a male bed tail gearbox housing 203, a large shaft bushing C304, a first small shaft bushing C3051, a second small shaft bushing C3052, a third small shaft bushing C3053, a first bearing shim C3061, a second bearing shim C3062, a third bearing shim C3063, a fourth bearing shim C3064, a first plane bearing C3071, a second plane bearing C3072, a first spring shim C3081, a second spring shim C3082, an open-end short shaft C309, a first dowel pin C3101, a second dowel pin C3102, a first bevel gear C3111, a second bevel gear C3112, a long shaft C312, a split pin C313 and a limiting shim C314.

The female bed tail gearbox housing 202 and the male bed tail gearbox housing 203 are respectively integrally molded by injection. The female bed tail gearbox housing 202 and the male bed tail gearbox housing 203 are internally provided with second convex and concave spaces which face each other and are used for clamping and fixing components. The structure of the bed tail gearbox is identical with the structure of the handle-containing bed tail gearbox.

The first bevel gear C3111 and the second bevel gear C3112 are positioned in the second convex and concave spaces, and are in mutually vertical arrangement and in engaged connection.

The open-end short shaft C309 is vertically arranged, with a lower end coupled and fixed with the first bevel gear C3111 and an upper end formed with an open slot which is mechanically connected with the transmission system 401. The open-end short shaft C309 is provided with the first dowel pin C3101 which limits and locks the first bevel gear C3111. The open-end short shaft C309 is sequentially annularly sleeved in the large shaft bushing C304, the first small shaft bushing C3051, the first bearing shim C3061, the first plane bearing C3071, the second bearing shim C3062 and the first spring shim C3081 which are limited by the second convex and concave spaces from the top down. The large shaft bushing C304 is positioned on the top of the open-end short shaft C309. The large shaft bushing C304 and the first small shaft bushing C3051 are respectively independently limited by the second convex and concave spaces. The first bearing shim C3061 and the first plane bearing C3071 and the second bearing shim C3062 and the first spring shim C3081 and the first bevel gear C3111 are in compact compression and connection, which means that the five components (the first bearing shim C3061, the first plane bearing C3071, the second bearing shim C3062, the first spring shim C3081 and the first bevel gear C3111) synchronize with the open-end short shaft C309 during rotation.

The long shaft C312 is horizontally arranged, coupled and fixed with the second bevel gear C3112. The long shaft C312 is provided with the second dowel pin C3102 which limits and locks the second bevel gear C3112. One end (right end) of the long shaft C312 passes through the limiting shim C314 and the third small shaft bushing C3053 which are limited by the second convex and concave spaces, and the end socket is provided with an open slot.

The other end (left end) of the long shaft C312 is sequentially annularly sleeved in the second spring shim C3082, the fourth bearing shim C3064, the second plane bearing C3072, the third bearing shim C3063 and the second small shaft bushing C3052 which are limited by the second convex and concave spaces from the right to the left, and extends out of the second convex and concave spaces, which means that the second small shaft bushing C3052 is positioned at the most left end. The end socket of the other end (left end) of the long shaft C312 is provided with the split pin C313 for being connected with the pull rod. The second spring shim C3082 and the fourth bearing shim C3064 and the second plane bearing C3072 and the third bearing shim C3063 and the second bevel gear C3112 are in compact compression and connection, which means that the five components (the second spring shim C3082, the fourth bearing shim C3064, the second plane bearing C3072, the third bearing shim C3063 and the second bevel gear C3112) can synchronize with the long shaft C312 during rotation. The second small shaft bushing C3052 is independently limited by the second convex and concave spaces.

As shown in FIG. 9, the motor gear connecting box 501 includes a female connecting box housing 502, a male connecting box housing 503, a short motor shaft 504, a coupling long shaft E505, a first small shaft bushing E5041, a third small shaft bushing E5051, a first limiting shim E5042, a second limiting shim E5052, a first bevel gear E5043, a second bevel gear E5053, a first split pin E5044, a second split pin E5054, a first dowel pin E5045, a second dowel pin E5055, a first spring shim E5046, a third split pin E5056, a first bearing shim E5047, a second spring shim E5057, a first plane bearing E5048, a third bearing shim E5058, a second bearing shim E5049, a second plane bearing E5059, a second small shaft bushing E50410, a fourth bearing shim E50510, a fourth small shaft bushing E50511, a coupling connector spring 506 and a coupling connector 507.

The female connecting box housing 502 and the male connecting box housing 503 are respectively molded by injection. The female connecting box housing 502 and the male connecting box housing 503 are internally provided with third convex and convex spaces which face each other and are for clamping and fixing components. Here, the so called convex and concave spaces (or the third convex and concave spaces) refer to the interiors of the female connecting box housing 502 and the male connecting box housing 503 which are internally molded by injection with molds according to external sizes or partial external sizes of components to be limited such that the corresponding components can be embedded therein, thus fulfilling the aim of fixing or limiting the components when the female connecting box housing 502 and the male connecting box housing 503 are folded.

The first bevel gear E5043 and the second bevel gear E5053 are positioned in the third convex and concave spaces, and are in mutually parallel arrangement and in engaged connection.

The so called (the first bevel gear E5043 and the second bevel gear E5053) mutually parallel arrangement and engaged connection is that the axes of the two bevel gears are parallel (for example, the directions of teeth of the bevel portions of the two bevel gears are the same, as shown FIG. 9) and that the teeth of the non-bevel portions of the two bevel gears are mutually engaged.

The short motor shaft 504 is horizontally arranged, coupled and fixed with the first bevel gear E5043. The short motor shaft 504 is provided with the first dowel pin E5045 which limits and locks the first bevel gear E5043. One end (or left end) of the short motor shaft 504 passes through the first limiting shim E5042 and the first small shaft bushing E5041 which are limited by the third convex and concave spaces, and extends out of the third convex and concave spaces, and the end socket is formed with a pin hole in which the first split pin E5044 is inserted. The other end (or right end) of the short motor shaft 504 is sequentially annularly sleeved in the first spring shim E5046, the first bearing shim E5047, the first plane bearing E5048, the second bearing shim E5049 and the second small shaft bushing E50410 which are limited by the third convex and concave spaces from the left to the right (which means that the second small shaft bushing E50410 is positioned at the most right end or outer end). The first bevel gear E5043 and the first spring shim E5046 and the first bearing shim E5047 and the first plane bearing E5048 and the second bearing shim E5049 are in compact compression and connection, which means that the five components (the first bevel gear E5043, the first spring shim E5046, the first bearing shim E5047, the first plane bearing E5048 and the second bearing shim E5049) synchronize with the short motor shaft E504 during rotation. The second small shaft bushing E50410 is independently limited by the third convex and concave spaces without projection.

The coupling long shaft E505 is horizontally arranged, coupled and fixed with the second bevel gear E5053. The coupling long shaft E505 is provided with the second dowel pin E5055 which limits and locks the second bevel gear E5053. One end (left end) of the coupling long shaft E505 passes through the second limiting shim E5052 and the third small shaft bushing E5051 which are limited by the third convex and concave spaces, and extends out of the third convex and concave spaces, and the end socket is formed with a pin hole in which the second split pin E5054 is inserted. The other end (right end) of the coupling long shaft E505 is sequentially annularly sleeved in the second spring shim E5057, the third bearing shim E5058, the second plane bearing E5059, the fourth bearing shim E50510 and the fourth small shaft bushing E50511 which are limited by the third convex and concave spaces from the left to the right. The fourth small shaft bushing E50511 is positioned at the most right end or outer end of the five components, and is independently limited by the third convex and concave spaces. The second bevel gear E5053 and the second spring shim E5057 and the third bearing shim E5058 and the second plane bearing E5059 and the fourth bearing shim E50510 are in compact compression and connection, which means that the five components (the second bevel gear E5053 and the second spring shim E5057 and the third bearing shim E5058 and the second plane bearing E5059 and the fourth bearing shim E50510) synchronize with the coupling long shaft E505 during rotation. The other end (right end) of the coupling long shaft E505 extends and gets out of the third convex and concave spaces, and the end socket is formed with a pin hole in which the third split pin E5056 is inserted. The coupling connector 507 is an integrally hollow cylindrical structure which is square outside and round inside, having slot holes on the lateral side; one end of the coupling connector is inserted into the coupling long shaft E505, and the other end is formed with a pin slot opening at the end socket. The coupling connector 507 is in pin connection with the other end or right end of the coupling long shaft E505 through the third split pin E5056. The coupling connector 507 is internally provided with the coupling connector spring 506.

What is claimed is:

1. A medical rehabilitation bed, comprising a bed head, a bed tail and a bed board, wherein a pull rod is arranged at a bottom of the bed board; the pull rod has one end mechanically connected to a bed head gearbox which is arranged at the bed head, and an other end mechanically connected to a bed tail gear device which is arranged at the bed tail; a plurality of transmission systems having a same structure and capable of controlling the bed head and the bed tail to ascend and descend are respectively arranged in the bed head and the bed tail; the plurality of transmission systems are mechanically connected to the bed head gearbox and the bed tail gear device, respectively;

the bed head comprises a bed stand, a bed head board, a bed head frame, a plurality of roller bayonets, a plurality of bayonets, a plurality of connectors, a plurality of connector dowel pins, a plurality of lifting racks, a plurality of roller fixing blocks and a plurality of rollers;

the bed stand is a dual-leg upper-lower framework structure; the bed head frame is processed as a groove-shaped rigid lath structure, and is fixed at an upper border of the bed stand through a plurality of bed head frame fixing screws; the upper border of the bed stand is a bottom-open groove-shaped structure; a lower border of the bed stand is a top-open groove-shaped structure; two ends of the lower border are respectively in fastening connection with two legs of the bed stand; the bed head board is a rigid plate structure, fixed at the upper and lower borders of the bed stand on two sides through the plurality of bed head frame fixing screws;

each leg of the bed stand has a hollow cylindrical rigid structure; a long hole is formed on an inner side of the leg; each of the plurality of lifting racks is a hollow cylindrical rigid structure, formed with a long hole on an inner side, and inserted into a corresponding leg from the bottom up; an upper end of each of the plurality of lifting racks is fixed to a corresponding one of the plurality of connectors through a corresponding one of the plurality of connector dowel pins, and a lower end fixes a corresponding one of the plurality of roller fixing blocks at the end socket through a corresponding one of the plurality of roller bayonets; each of the plurality of roller fixing blocks is connected with a corresponding one of the plurality of rollers; each of the plurality of connectors is provided with a bayonet which supports a corresponding leg and performs a damping role; the bayonet is a spring;

the bed tail and the bed head have a same structure;

a motor gear connecting box which is mechanically connected to a motor is disposed at the bottom of the bed board; the motor gear connecting box is provided with a coupling connector; the coupling connector is capable of being connected or disconnected with the pull rod;

the bed tail gear device is a bed tail gearbox or a handle-containing bed tail gearbox;

in a state in which the coupling connector is connected with the pull rod, the motor drives the pull rod to rotate through the motor gear connecting box so that a structure is formed, wherein the bed head gearbox disposed at the bed head is capable of driving the bed head to ascend and descend through the plurality of transmission systems in a mechanical connection, the bed tail gear device disposed at the bed tail is capable of driving the bed tail to ascend and descend through the plurality of transmission systems in a mechanical connection;

wherein the motor gear connecting box comprises a female connecting box housing, a male connecting box housing, a short motor shaft, a coupling long shaft, a first small shaft bushing, a third small shaft bushing, a first limiting shim, a second limiting shim, a first bevel gear, a second bevel gear, a first split pin, a second split pin, a first dowel pin, a second dowel pin, a first spring shim, a third split pin, a first bearing shim, a second spring shim, a first plane bearing, a third bearing shim, a second bearing shim, a second plane bearing, a second small shaft bushing, a fourth bearing shim, a fourth small shaft bushing, a coupling connector spring and a coupling connector;

the female connecting box housing and the male connecting box housing are respectively integrally molded by injection; the female connecting box housing and the male connecting box housing are internally provided with a plurality of third convex and concave spaces which face each other and are used for clamping and fixing a plurality of components;

the first bevel gear and the second bevel gear are positioned in the plurality of third convex and concave spaces, and are in mutually parallel arrangement and in engaged connection;

the short motor shaft is horizontally arranged, coupled and fixed with the first bevel gear; the short motor shaft is provided with the first dowel pin which limits and locks the first bevel gear; one end of the short motor shaft passes through the first limiting shim and the first small shaft bushing which are limited by the plurality of third convex and concave spaces, extends out of the plurality of third convex and concave spaces, and has an end socket which is formed with a pin hole in which the first split pin is inserted; an other end of the short motor shaft is sequentially annularly sleeved in the first spring shim, the first bearing shim, the first plane bearing, the second bearing shim and the second small shaft bushing which are limited by the plurality of third convex and concave spaces from the left to the right; the first bevel gear and the first spring shim and the first bearing shim and the first plane bearing and the second bearing shim are in compact compression and connection;

the coupling long shaft is horizontally arranged, coupled and fixed with the second bevel gear; the coupling long shaft is provided with the second dowel pin which limits and locks the second bevel gear; one end of the coupling long shaft passes through the second limiting shim and the third small shaft bushing which are limited by the plurality of third convex and concave spaces, extends out of the plurality of third convex and concave spaces, and has an end socket which is formed with a pin hole in which the second split pin is inserted; an other end of the coupling long shaft is sequentially annularly sleeved in the second spring shim, the third bearing shim, the second plane bearing, the fourth bearing shim and the fourth small shaft bushing which are limited by the plurality of third convex and concave spaces from the left to the right; the second bevel gear and the second spring shim and the third bearing shim and the second plane bearing and the fourth bearing shim are in compact compression and connection; the other end of the coupling long shaft is capable of extending out of the plurality of third convex and concave spaces, and has an end socket which is formed with a pin hole in which the third split pin is inserted; the coupling connector is an integrally hollow cylindrical structure which is square outside and round inside, having a plurality of slot holes on a lateral side; one end of the coupling connector is inserted into the coupling long shaft, and an other end is formed with a pin slot opening at the end socket; the coupling connector is in pin connection with the other end or a right end of the coupling long shaft through the third split pin; and the coupling connector is internally provided with the coupling connector spring.

2. The medical rehabilitation bed according to claim 1, wherein each one of the plurality of transmission systems comprises a support rod, a support rod pin, an internal-thread lifting head limiting pin, a cap, a spiral lifting rod, a screw rod limiting pin, an internal-thread sleeve, an internal-thread lifting head, a steel cable fixing screw, a plurality of fixed sleeves, a sleeve mouth plate, a steel cable, a steel cable roller dowel pin, and a plurality of steel cable rollers;

the spiral lifting rod is positioned between the upper and lower borders of the bed stand in a vertical way, and is formed with an H-shaped cylindrical cap at the end socket of the upper end; the cap supports the upper border; a lower end of the spiral lifting rod passes through the lower border and is mechanically connected to the bed head gearbox or the bed tail gear device;

the internal-thread sleeve is a standing round tube structure, symmetrically formed with two rectangular through-holes on a side wall; the side wall below the two rectangular through-holes integrally extends outward; and an extending portion is an overall rectangular plate structure which is vertical to an axis; the rectangular plate structure is formed with two first through-holes along one diagonal line, and is formed with two screw holes along another diagonal line; a second through-hole is disposed between each of the two first through-holes and each of the screw holes; a diameter of each of a plurality of second through-holes is smaller than a diameter of a corresponding one of the screw holes, and each of the second through-holes communicates with the corresponding one of the screw holes;

a plurality of support rods in parallel with an axis of the spiral lifting rod are respectively disposed on two sides of the spiral lifting rod; the plurality of support rods pass through the two first through-holes; two ends of each of the plurality of support rods are respectively connected with the upper and lower borders of the bed stand in a riveted way; the spiral lifting rod is fixed with two screw rod limiting pins; the screw rod limiting pins are respectively positioned between the internal-thread sleeve and the cap and between the internal-thread sleeve and an end socket of a lower end of the spiral lifting rod;

the internal-thread lifting head is a standing round tube structure, respectively provided with a plurality of screw threads on inner and outer walls; the internal-thread lifting head is located in the internal-thread sleeve; a plurality of internal screw threads are in spiral connection with the spiral lifting rod; a plurality of internal-thread head limiting pins are respectively disposed at upper and lower end faces of the internal-thread lifting head; the plurality of internal-thread lifting head limiting pins are parallel to an axis of the internal-thread lifting head;

the sleeve mouth plate has an arc-shaped plate structure, having an inner wall provided with the plurality of internal screw threads at a screw pitch which is the same as that of a plurality of external screw threads of the internal-thread lifting head; the sleeve mouth plate is embedded in one of the rectangular through-holes of the internal-thread sleeve and is in spiral connection with the plurality of external screw threads of the internal-thread lifting head;

the plurality of fixed sleeves are semi-round plate structures, the plurality of fixed sleeves wrap around the internal-thread sleeve and the sleeve mouth plate in pairs and are fastened and connected to form a round tube structure;

a plurality of plural steel cable rollers are uniformly distributed in the lower border of the bed stand and are pinned and fixed with the lower border through a plurality of steel cable roller dowel pins;

a steel cable by passes the plurality of plural steel cable rollers; one end of the steel cable is connected with one of the plurality of connector dowel pins, and an other end of the steel cable is connected with the steel cable fixing screw; the steel cable fixing screw passes through the screw hole in the rectangular plate structure and is clamped at the corresponding second through-hole;

a structure is formed, in which the internal-thread sleeve integrally moves up and down on the spiral lifting rod, driving the extension and withdrawal of the steel cable, and then driving the plurality of lifting racks 408 to move up and down through the steel cable.

3. The medical rehabilitation bed according to claim 1, wherein the bed head gearbox comprises a female bed head gearbox housing, a male bed head gearbox housing, a large shaft bushing, a first small shaft bushing, a second small shaft bushing, a third small shaft bushing, a first bearing shim, a second bearing shim, a third bearing shim, fourth bearing shim, a first plane bearing, a second plane bearing, a first spring shim, a second spring shim, an open-end short shaft, a first dowel pin, a second dowel pin, a first bevel gear, a second bevel gear, a limiting shim, a closed-end long shaft and a split pin;

the female bed head gearbox housing and the male bed head gearbox housing are respectively integrally molded by injection; the female bed head gearbox housing and the male bed head gearbox housing are internally provided with a plurality of first convex and concave spaces which face each other and are used for clamping and fixing a plurality of components;

the first bevel gear and the second bevel gear are positioned in the plurality of first convex and concave spaces, and are in a mutually vertical arrangement and in an engaged connection;

the open-end short shaft is vertically disposed, with a lower end coupled and fixed with the first bevel gear and an upper end formed with an open slot which is mechanically connected with the plurality of transmission systems; the open-end short shaft is provided with the first dowel pin which limits and locks the first bevel gear; the open-end short shaft is sequentially annularly sleeved in the large shaft bushing, the first small shaft bushing, the first bearing shim, the first plane bearing, the second bearing shim and the first spring shim which are limited by the plurality of first convex an concave spaces from the top down; the first bearing shim and the first plane bearing and the second bearing shim and the first spring shim and the first bevel gear are in compact compression and connection;

the closed-end long shaft is horizontally arranged, coupled and fixed with the second bevel gear; the closed-end long shaft is provided with the second dowel pin which limits and locks the second bevel gear; one end of the closed-end long shaft passes through the limiting shim and the second small shaft bushing which are limited by the plurality of first convex and concave spaces, and extends out, the one end of the closed-end long shaft is provided with the split pin for being connected with the pull rod; an other end of the closed-end long shaft is sequentially annularly sleeved in the third small shaft bushing, the fourth bearing shim, the second plane bearing, the third bearing shim and the second spring shim which are limited by the plurality of first convex and concave spaces from the right to the left; and the fourth bearing shim and the second plane bearing and the third bearing shim and the second spring shim and the second bevel gear are in compact compression and connection.

4. The medical rehabilitation bed according to claim 1, wherein the handle-containing bed tail gearbox comprises a female bed tail gearbox housing, a male bed tail gearbox housing, a large shaft bushing, a first small shaft bushing, a second small shaft bushing, a third small shaft bushing, a first bearing shim, a second bearing shim, a third bearing shim, a fourth bearing shim, a first plane bearing, a second plane bearing, a first spring shim, a second spring shim, an open-end short shaft, a first dowel pin, a second dowel pin, a first bevel gear, a second bevel gear, a long shaft, a split pin and a handle;

the female bed tail gearbox housing and the male bed tail gearbox housing are respectively internally molded by injection; the female bed tail gearbox housing and the male bed tail gearbox housing are internally provided with a plurality of second convex and concave spaces which face each other and are used for clamping and fixing a plurality of components;

the first bevel gear and the second bevel gear are positioned in the plurality of second convex and concave spaces, and are in a mutually vertical arrangement and in an engaged connection;

the open-end short shaft is vertically disposed, with a lower end coupled and fixed with the first bevel gear and an upper end formed with an open slot which is mechanically connected with the plurality of transmission systems; the open-end short shaft is provided with the first dowel pin which limits and locks the first bevel gear; the open-end short shaft is sequentially annularly sleeved in the large shaft bushing, the first small shaft bushing, the first bearing shim, the first plane bearing, the second bearing shim and the first spring shim which are limited by the plurality of second convex and concave spaces from the top down; the first bearing shim and the first plane bearing and the second bearing shim and the first spring shim and the first bevel gear are in compact compression and connection;

the long shaft is horizontally arranged, coupled and fixed with the second bevel gear; the long shaft is provided with the second dowel pin which limits and locks the second bevel gear; one end of the long shaft passes through the third small shaft bushing which is limited by the plurality of second convex and concave spaces, and extends out, an end of the long shaft is provided with an open slot and is fixedly connected with the handle through the open slot;

an other end of the long shaft is sequentially annularly sleeved in the second spring shim, the fourth bearing shim, the second plane bearing, the third bearing shim, and the second small shaft bushing which are limited by the plurality of second convex and concave spaces from the right to the left, and extends out of the plurality of second convex and concave spaces; an end socket of the other end of the long shaft is provided with the split pin for being connected with the pull rod; the second spring shim and the fourth bearing shim and the second plane bearing and the third bearing shim and the second bevel gear are in compact compression and connection;

the handle comprises a handle fixing screw, a grip dowel pin, grip shims, a grip spring, a grip bolt, a grip and a grip connector; the handle wall of the handle is a cylindrical rigid structure; an end socket of one end of a handle wall is provided with an annular connecting portion in an integrated or fastened way; the grip connector is sunk in the annular connecting portion and is connected with the annular connecting portion in a fastened way through the handle fixing screw; an end socket of an other end of the handle wall of the handle is formed with a groove or a recessed portion;

the grip connector is an integrally columnar; one end of the grip connector is provided with a projecting portion; the projecting portion is inserted in the open slot formed on the long shaft and forms an interlocking structure;

the grip is a hollow cylindrical structure, internally inserted with the grip bolt; the grip bolt is annularly sleeved with the grip spring which is held by two grip shims; an end socket of one end of the grip bolt is inserted into the groove or the recession portion which is formed at the end socket of the other end of the handle wall of the handle and is connected in a riveted way through the grip dowel pin; and an end socket of an other end of the grip bolt is provided with a limiting portion which limits a slide-out of the grip.

5. The medical rehabilitation bed according to claim 1, wherein the bed tail gearbox comprises a female bed tail gearbox housing, a male bed tail gearbox housing, a large shaft bushing, a first small shaft bushing, a second small shaft bushing, a third small shaft bushing, a first bearing shim, a second bearing shim, a third bearing shim, a fourth bearing shim, a first plane bearing, a second plane bearing, a first spring shim, a second spring shim, an open-end short shaft, a first dowel pin, a second dowel pin, a first bevel gear, a second bevel gear, a long shaft, a split pin, and a limiting shim;

the female bed tail gearbox housing and the male bed tail gearbox housing are respectively integrally molded by injection; the female bed tail gearbox housing and the male bed tail gearbox housing are internally provided with the plurality of second convex and concave spaces which face each other and are used for clamping and fixing a plurality of components;

the first bevel gear and the second bevel gear are positioned in the plurality of second convex and concave spaces, and are in a mutually vertical arrangement and in an engaged connection;

the open-end short shaft is vertically disposed, with a lower end coupled and fixed with the first bevel gear and an upper end formed with an open slot which is mechanically connected with the plurality of transmission systems; open-end short shaft is provided with the first dowel pin which limits and locks the first bevel gear; the open-end short shaft is sequentially annularly sleeved in the large shaft bushing, the first small shaft bushing, the first bearing shim, the first plane bearing, the second bearing shim and the first spring shim which are limited by the plurality of second convex and concave spaces from the top down; the first bearing shim and the first plane bearing and the second bearing shim and the first spring shim and the first bevel gear are in compact compression and connection;

the long shaft is horizontally arranged, coupled and fixed with the second bevel gear; the long shaft is provided with the second dowel pin which limits and locks the second bevel gear; one end of the long shaft passes through the limiting shim and the third small shaft bushing which are limited by the plurality of second convex and concave spaces, and has an end socket which is provided with an open slot;

an other end of the long shaft is sequentially annularly sleeved in the second spring shim, the fourth bearing shim, the second plane bearing, the third bearing shim and the second small shaft bushing which are limited by the plurality of second convex and concave spaces from the right to the left, and extends out of the plurality of second convex and concave spaces; an end socket of the other end of the long shaft is provided with the split pin for being connected with the pull rod; the second spring shim and the fourth bearing shim and the second plane bearing and the third bearing shim and the second bevel gear are in compact compression and connection.

* * * * *